US009373343B2

(12) United States Patent
Dickins et al.

(10) Patent No.: US 9,373,343 B2
(45) Date of Patent: Jun. 21, 2016

(54) METHOD AND SYSTEM FOR SIGNAL TRANSMISSION CONTROL

(71) Applicant: DOLBY LABORATORIES LICENSING CORPORATION, San Francisco, CA (US)

(72) Inventors: Glenn N. Dickins, Como (AU); Zhiwei Shuang, Beijing (CN); David Gunawan, Sydney (AU); Xuejing Sun, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/382,667

(22) PCT Filed: Mar. 21, 2013

(86) PCT No.: PCT/US2013/033243
§ 371 (c)(1),
(2) Date: Sep. 3, 2014

(87) PCT Pub. No.: WO2013/142659
PCT Pub. Date: Sep. 26, 2013

(65) Prior Publication Data

US 2015/0032446 A1 Jan. 29, 2015

Related U.S. Application Data

(60) Provisional application No. 61/619,187, filed on Apr. 2, 2012.

(30) Foreign Application Priority Data

Mar. 23, 2012 (CN) ..... 2012 1 0080977

(51) Int. Cl.
*G10L 25/78* (2013.01)
*G10L 25/48* (2013.01)
*G10L 25/84* (2013.01)

(52) U.S. Cl.
CPC ..... *G10L 25/84* (2013.01); *G10L 25/78* (2013.01); *G10L 2025/783* (2013.01)

(58) Field of Classification Search
CPC ..... G10L 25/78; G10L 25/48; G10L 21/0208; G10L 19/012; G10L 2021/02168; G10L 25/84; G10L 15/02; G10L 15/20; G10L 19/022
USPC ..... 704/233, 226, 231, 200, 208–210, 704/214–215, E11.005, E11.003, E19.006
See application file for complete search history.

(56) References Cited

U.S. PATENT DOCUMENTS 5,774,846 A 6/1998 Morii
6,122,384 A 9/2000 Mauro (Continued)

FOREIGN PATENT DOCUMENTS

CN 1354455 6/2002

OTHER PUBLICATIONS

Davis, A. et al "Statistical Voice Activity Detection Using Low-Variance Spectrum Estimation and an Adaptive Threshold" IEEE Transactions on Audio, Speech, and Language Processing, vol. 14, No. 2, Mar. 2006, pp. 412-424.

(Continued)

*Primary Examiner* — Marivelisse Santiago Cordero
*Assistant Examiner* — Stephen Brinich

(57) ABSTRACT

An audio signal with a temporal sequence of blocks or frames is received or accessed. Features are determined as characterizing aggregately the sequential audio blocks/frames that have been processed recently, relative to current time. The feature determination exceeds a specificity criterion and is delayed, relative to the recently processed audio blocks/frames. Voice activity indication is detected in the audio signal. VAD is based on a decision that exceeds a preset sensitivity threshold and is computed over a brief time period, relative to blocks/frames duration, and relates to current block/frame features. The VAD and the recent feature determination are combined with state related information, which is based on a history of previous feature determinations that are compiled from multiple features, determined over a time prior to the recent feature determination time period. Decisions to commence or terminate the audio signal, or related gains, are outputted based on the combination.

20 Claims, 10 Drawing Sheets

(56) References Cited

U.S. PATENT DOCUMENTS

| | | | | |
|---|---|---|---|---|
| 6,182,035 | B1 | 1/2001 | Mekuria | |
| 6,188,981 | B1 | 2/2001 | Benyassine | |
| 6,427,134 | B1 | 7/2002 | Garner | |
| 6,453,289 | B1 | 9/2002 | Ertem | |
| 6,453,291 | B1 | 9/2002 | Ashley | |
| 6,615,170 | B1 | 9/2003 | Liu | |
| 6,810,273 | B1 | 10/2004 | Mattila | |
| 7,155,018 | B1 | 12/2006 | Stokes, III | |
| 7,454,332 | B2 | 11/2008 | Koishida | |
| 7,464,029 | B2 | 12/2008 | Visser | |
| 7,516,065 | B2 | 4/2009 | Marumoto | |
| 7,596,487 | B2 | 9/2009 | Gass | |
| 7,769,585 | B2 | 8/2010 | Wahab | |
| 7,809,555 | B2 | 10/2010 | Kim | |
| 7,889,874 | B1 | 2/2011 | Ayad | |
| 2001/0014857 | A1 | 8/2001 | Wang | |
| 2001/0034601 | A1 | 10/2001 | Chujo | |
| 2002/0075856 | A1 | 6/2002 | LeBlanc | |
| 2002/0198708 | A1 | 12/2002 | Zak | |
| 2005/0171769 | A1 | 8/2005 | Naka | |
| 2006/0053007 | A1 | 3/2006 | Niemisto | |
| 2006/0161430 | A1* | 7/2006 | Schweng | G10L 25/78 704/233 |
| 2008/0027716 | A1 | 1/2008 | Rajendran | |
| 2008/0040109 | A1 | 2/2008 | Muralidhar | |
| 2009/0125305 | A1* | 5/2009 | Cho | G10L 25/78 704/233 |
| 2010/0017205 | A1 | 1/2010 | Visser | |
| 2010/0088094 | A1 | 4/2010 | Wang | |
| 2010/0121634 | A1* | 5/2010 | Muesch | G10L 21/0205 704/224 |
| 2010/0211385 | A1 | 8/2010 | Sehlstedt | |
| 2010/0260273 | A1 | 10/2010 | Raifel | |
| 2011/0066429 | A1 | 3/2011 | Shperling | |
| 2011/0238418 | A1 | 9/2011 | Wang | |
| 2011/0246185 | A1* | 10/2011 | Arakawa | G10L 25/78 704/200 |

OTHER PUBLICATIONS

Beritelli, F. et al "A Robust Voice Activity Detector for Wireless Communications Using Soft Computing" Dec. 1998, pp. 1818-1829, IEEE Journal on Selected Areas in Communications, vol. 16, Issue 9.

Ramirez, J. et al "Speech/Non-Speech Discrimination Based on Contextual Information Integrated Bispectrum LRT" IEEE Signal Processing Letters, vol. 13, No. 8, Aug. 2006, pp. 497-500.

Beritelli, F. et al "Adaptive Voice Activity Detection for Wireless Communications Based on Hybrid Fuzzy Learning" IEEE Global Telecommunications Conference, Nov. 1998, pp. 1729-1734, vol. 3.

Cavallaro, A. et al "A Fuzzy Logic-Based Speech Detection Algorithm for Communications in Noisy Environments" Proc. of the IEEE International Conference on Acoustics, Speech and Signal Processing, May 12-15, 1998, pp. 565-568, vol. 1.

Ahn, Sang-Sik, et al "An Improved Statistical Model-Based VAD Algorithm with an Adaptive Threshold" Journal of the Chinese Institute of Engineers, vol. 29, No. 5, pp. 783-789, Mar. 4, 2011.

Martin, Rainier "Spectral Subtraction Based on Minimum Statistics" EUSIPCO, Sep. 1994.

Cohen, Israel. "Noise Spectrum Estimation in Adverse Environments: Improved Minima Controlled Recursive Averaging" IEEE Transactions on Speech and Audio Processing, Sep. 2003, vol. 11, Issue 5, pp. 466-475.

Freund, Y. et al "A Decision-Theoretic Generalization of On-Line Learning and an Application to Boosting" Appearing in the Proceedings of the Second European Conference on Computational Learning Theory, Mar. 1995.

Scholkopfk, B. et al "Learning with Kernels: Support Vector Machines, Regularization, Optimization, and Beyond" MIT Press, Dec. 2001.

Kang, Jin Ah, et al "A Smart Background Music Mixing Algorithm for Portable Digital Imaging Devices" IEEE Transactions on Consumer Electronics, New York, USA, vol. 57, No. 3, Aug. 2011, pp. 1258-1263.

Lamblin Claude France Telecom France: Draft Revised ITU-T Recommendation G.729 a Coding of Speech at 8 kbit/s Using Conjugate-Structure Algebraic-Code-Excited Linear Prediction (CS-ACELP), ITU-T, International Telecommunication Union, Geneva, CH, vol. 10/16, Nov. 14, 2006, pp. 1-144.

Beritelli, F. et al "Performance Evaluation and Comparison of G.729/AMR/Fuzzy Voice Activity Detectors" IEEE Signal Processing Letters, vol. 9, Issue 3, Mar. 2002, pp. 85-88.

Davis, A. "A Study of Voice Activity Detectors" Electrical and Computer Engineering, Perth, Curtin University of Technology, Ph.D., 2008.

Gilg, V. et al "Methodology for the Design of a Robust Voice Activity Detector for Speech Enhancement" International Workshop on Acoustic Echo and Noise Control, Kyoto, Japan, IEEE, Sep. 2003.

Kularatna, N. et al Essentials of Modern Telecommunications Systems, Artech House, May 2004, 396 pages.

Ramirez, J. et al "Voice Activity Detection. Fundamentals and Speech Recognition System Robustness" Robust Speech Recognition and Understanding, Jun. 2007.

Ravichandran, T. et al "Performance Evaluation and Comparison of Voice Activity Detection Algorithms" International Journal of Soft Computing, 257-261, 2007.

* cited by examiner

METHOD AND SYSTEM FOR SIGNAL TRANSMISSION CONTROL

CROSS-REFERENCE TO RELATED APPLICATIONS

This application claims priority to Chinese Patent Application No. 201210080977.X, filed 23 Mar. 2012 and U.S. Patent Provisional Application No. 61/619,187, filed 2 Apr. 2012, each of which is hereby incorporated by reference in its entirety.

TECHNICAL FIELD

The present invention relates generally to audio signal processing. More specifically, embodiments of the present invention relate to signal transmission control.

BACKGROUND

Voice activity detection (VAD) is a technique for determining a binary or probabilistic indicator of the presence of voice in a signal containing a mixture of voice and noise. Often the performance of voice activity detection is based on the accuracy of classification or detection. Research work is motivated by the use of voice activity detection algorithms for improving the performance of speech recognition or for controlling the decision to transmit a signal in systems benefiting from an approach to discontinuous transmission. Voice activity detection is also used for controlling signal processing functions such as noise estimation, echo adaption and specific algorithmic tuning such as the filtering of gain coefficients in noise suppression systems.

The output of voice activity detection may be used directly for subsequent control or meta-data, and/or be used to control the nature of audio processing algorithms working on the real time audio signal.

One particular application of interest for voice activity detection is in the area of Transmission Control. For communication systems where an endpoint may cease transmission, or send a reduced data rate signal during periods of voice inactivity, the design and performance of a voice activity detector is critical to the perceived quality of the system. Such a detector must ultimately make a binary decision, and is subject to the fundamental problem that in many features observable on a short time frame, to achieve low latency, there are characteristics of speech and noise that substantially overlap. Hence, such a detector must constantly face a tradeoff between the prevalence of false alarms and the possibility of lost desired speech due to incorrect decisions. The opposing requirements of low latency, sensitivity and specificity have no completely optimal solution, or at least create an operational landscape where the efficiency or optimality of a system is dependent on the application and expected input signal.

SUMMARY

An audio signal that has a temporal sequence of blocks or frames is received or accessed. Two or more features are determined as characterizing aggregately two or more of the sequential audio blocks or frames that have been processed previously within a time period that is recent in relation to a current point in time. The feature determination exceeds a specificity criterion and is delayed in relation to the recently processed audio blocks or frames. An indication of voice activity is detected in the audio signal. The voice activity detection (VAD) is based on a decision that exceeds a preset sensitivity threshold and that is computed over a time period, which is brief in relation to the duration of each of the audio signal blocks or frames. The VAD decision relates to one or more features of a current audio signal block or frame. The high sensitivity short term VAD and the recent high specificity audio block or frame feature determination is combined with state related information. The state related information is based on a history of one or more previously computed feature determinations. The previously computed feature determination history is compiled from multiple features that are determined over a time that is prior to the recent high specificity audio block or frame feature determination time period. A decision that relates to a commencement or termination of the audio signal, or a gain related thereto, is outputted based on the combination.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF DRAWINGS

The present invention is illustrated by way of example, and not by way of limitation, in the figures of the accompanying drawings and in which like reference numerals refer to similar elements and in which.

DETAILED DESCRIPTION

Figure 1:
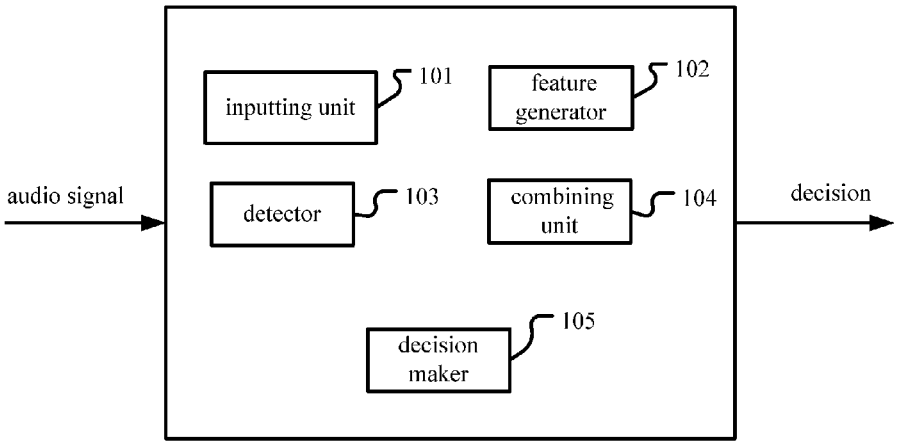
FIG. 1 is a block diagram illustrating an example apparatus according to an embodiment of the invention.

The embodiments of the present invention are below described by referring to the drawings. It is to be noted that, for purpose of clarity, representations and descriptions about those components and processes known by those skilled in the art but not necessary to understand the present invention are omitted in the drawings and the description.

As will be appreciated by one skilled in the art, aspects of the present invention may be embodied as a system, a device (e.g., a cellular telephone, portable media player, personal computer, television set-top box, or digital video recorder, or any media player), a method or a computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof.

A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wired line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1 is a block diagram illustrating an example apparatus 100 according to an embodiment of the invention.

As illustrated in FIG. 1, the apparatus 100 includes an inputting unit 101, a feature generator 102, a detector 103, a combining unit 104 and decision maker 105.

The inputting unit 101 is configured to receive or access an audio signal that comprises a plurality of temporally sequential blocks or frames.

The feature generator 102 is configured to determine two or more features that characterize aggregately two or more of the sequential audio blocks or frames that have been processed previously within a time period that is recent in relation to a current point in time, wherein the feature determination exceeds a specificity criterion and is delayed in relation to the recently processed audio blocks or frames.

The detector 103 is configured to detect an indication of voice activity in the audio signal, wherein the voice activity detection (VAD) is based on a decision that exceeds a preset sensitivity threshold and that is computed over a time period, which is brief in relation to the duration of each of the audio signal blocks or frames, and wherein the decision relates to one or more features of a current audio signal block or frame.

The combining unit 104 is configured to combine the high sensitivity short term VAD, the recent high specificity audio block or frame feature determination and information that relates to a state, which is based on a history of one or more previously computed feature determinations that are compiled from a plurality of features that are determined over a time that is prior to the recent high specificity audio block or frame feature determination time period.

The decision maker 105 is configured to output a decision relating to a commencement or termination of the audio signal, or a gain related thereto, based on the combination.

In a further embodiment, the combining unit 104 may be further configured to combine one or more signals or determinations that relate to a feature that comprises a current or previously processed characteristic of the audio signal.

In a further embodiment, the state may relate to one or more of a nuisance characteristic or a ratio of voice content in the audio signal to a total audio content thereof.

In a further embodiment, the combining unit 104 may be further configured to combine information that relates to a far end device or audio condition, which is communicatively coupled with a device that is performing the method.

In a further embodiment, the apparatus 100 may further comprise a nuisance estimator (not illustrated in the figure). The nuisance estimator analyzes the determined features that characterize the recently processed audio blocks or frames. Based on the determined features analysis, the nuisance estimator infers that the recently processed audio blocks or frames contain at least one undesired temporal signal segment. Then, The nuisance estimator measures a nuisance characteristic based on the undesirable signal segment inference.

In a further embodiment, the measured nuisance characteristic may vary.

In a further embodiment, the measured nuisance characteristic may vary monotonically.

In a further embodiment, the high specificity previous audio block or frame feature determination may comprise one or more of a ratio or a prevalence of desired voice content in relation to the undesired temporal signal segment.

In a further embodiment, the apparatus 100 may further comprise a first computing unit (not illustrated in the figure) configured to compute a moving statistic that relates to the desired voice content ratio or prevalence in relation to the undesired temporal signal segment.

In a further embodiment, the apparatus 100 may further comprise a second calculating unit (not illustrated in the figure) configured to determine one or more features that identify a nuisance characteristic over the aggregate of two or more of the previously processed sequential audio blocks or frames, wherein the nuisance measurement is further based on the nuisance feature identification.

In a further embodiment, the apparatus 100 may further comprise a first controller (not illustrated in the figure) configured to control a gain application, and smooth the desired temporal audio signal segment commencement or termination based on the gain application control.

In a further embodiment, the smoothed desired temporal audio signal segment commencement may comprise a fade-in, and the smoothed desired temporal audio signal segment termination may comprise a fade-out.

In a further embodiment, the apparatus 100 may further comprise a second controller (not illustrated in the figure) configured to control a gain level based on the measured nuisance characteristic.

Figure 2:
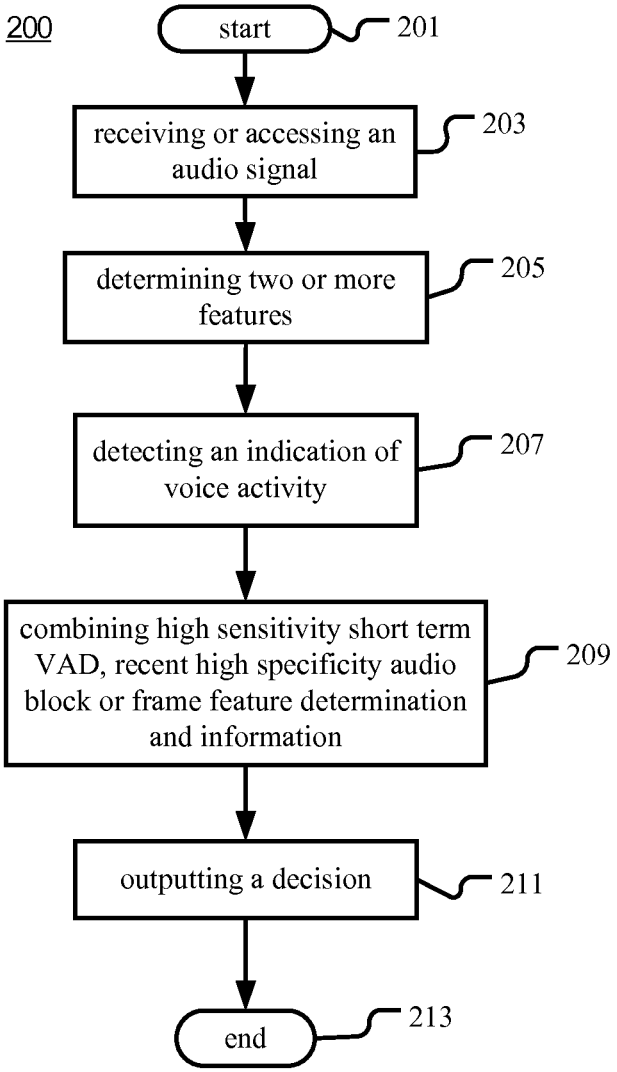
FIG. 2 is a flow chart illustrating an example method according to an embodiment of the invention.

FIG. 2 is a flow chart illustrating an example method 200 according to an embodiment of the invention.

As illustrated in FIG. 2, the method 200 starts from step 201. At step 203, an audio signal that comprises a plurality of temporally sequential blocks or frames is received or accessed.

At step 205, two or more features are determined. The features characterize aggregately two or more of the sequential audio blocks or frames that have been processed previously within a time period that is recent in relation to a current point in time, wherein the feature determination exceeds a specificity criterion and is delayed in relation to the recently processed audio blocks or frames.

At step 207, an indication of voice activity in the audio signal is detected, wherein the voice activity detection (VAD) is based on a decision that exceeds a preset sensitivity threshold and that is computed over a time period, which is brief in relation to the duration of each of the audio signal blocks or frames, and wherein the decision relates to one or more features of a current audio signal block or frame.

At step 209, obtaining a combination of the high sensitivity short term VAD, the recent high specificity audio block or frame feature determination and information that relates to a state, which is based on a history of one or more previously computed feature determinations that are compiled from a plurality of features that are determined over a time that is prior to the recent high specificity audio block or frame feature determination time period.

At step 211, a decision relating to a commencement or termination of the audio signal, or a gain related thereto, is output based on the combination.

The method ends at step 213.

In a further embodiment of the method 200, the step 209 may further comprise combining one or more signals or determinations that relate to a feature that comprises a current or previously processed characteristic of the audio signal.

In a further embodiment of the method 200, the state may relate to one or more of a nuisance characteristic or a ratio of voice content in the audio signal to a total audio content thereof.

In a further embodiment of the method 200, the step 209 may further comprise combining information that relates to a far end device or audio condition, which is communicatively coupled with a device that is performing the method.

In a further embodiment of the method 200, the method 200 may further comprise: analyzing the determined features that characterize the recently processed audio blocks or frames; based on the determined features analysis, inferring that the recently processed audio blocks or frames contain at least one undesired temporal signal segment; and measuring a nuisance characteristic based on the undesirable signal segment inference.

In a further embodiment of the method 200, the measured nuisance characteristic may vary.

In a further embodiment of the method 200, the measured nuisance characteristic may vary monotonically.

In a further embodiment of the method 200, the high specificity previous audio block or frame feature determination may comprise one or more of a ratio or a prevalence of desired voice content in relation to the undesired temporal signal segment.

In a further embodiment of the method 200, the method 200 may further comprise computing a moving statistic that relates to the desired voice content ratio or prevalence in relation to the undesired temporal signal segment.

In a further embodiment of the method 200, the method 200 may further comprise: determining one or more features that identify a nuisance characteristic over the aggregate of two or more of the previously processed sequential audio blocks or frames; wherein the nuisance measurement is further based on the nuisance feature identification.

In a further embodiment of the method 200, the method 200 may further comprise: controlling a gain application; and smoothing the desired temporal audio signal segment commencement or termination based on the gain application control.

In a further embodiment of the method 200, the smoothed desired temporal audio signal segment commencement may comprise a fade-in; and the smoothed desired temporal audio signal segment termination may comprise a fade-out.

In a further embodiment of the method 200, the method 200 may further comprise controlling a gain level based on the measured nuisance characteristic.

Figure 3:
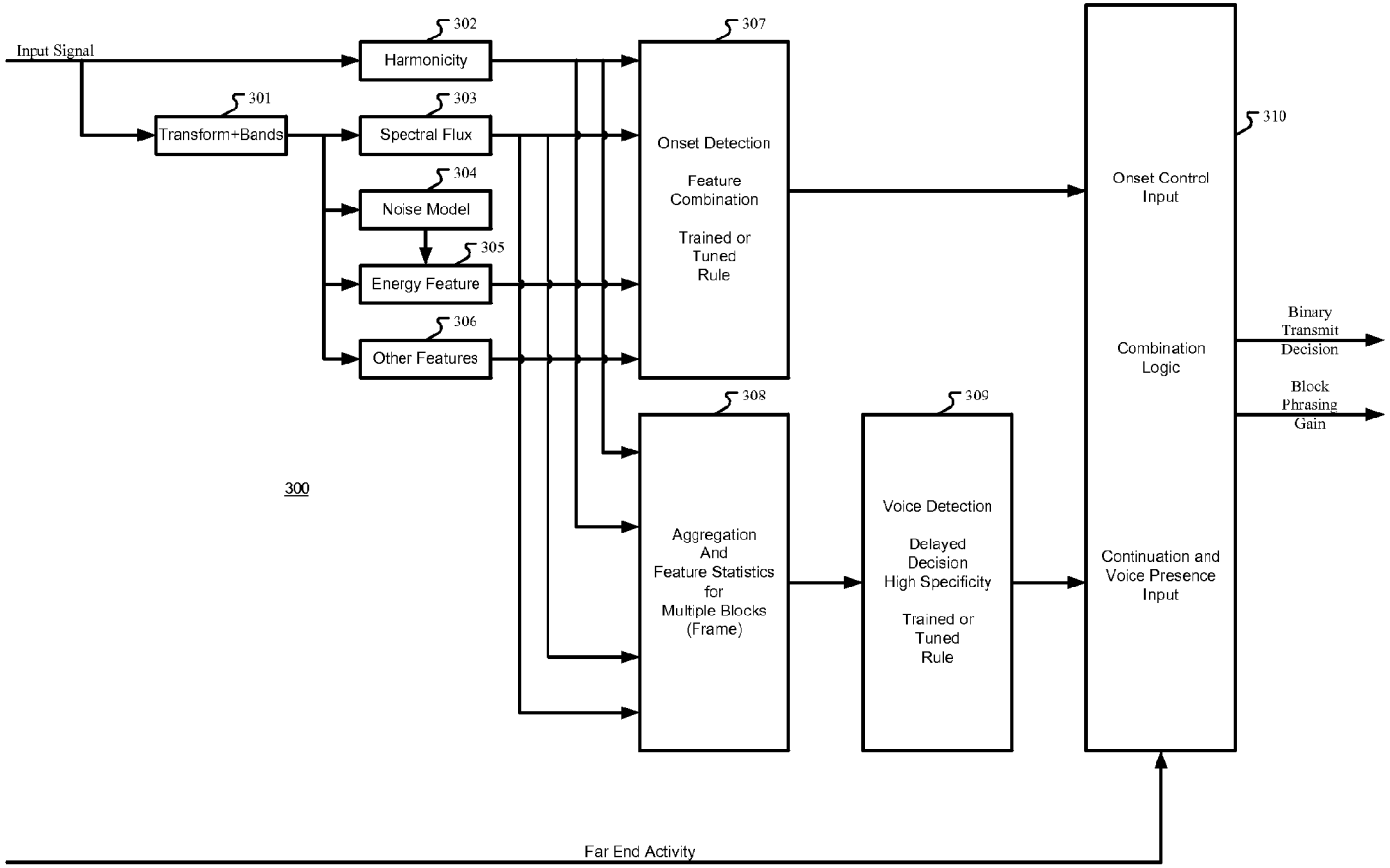
FIG. 3 is a block diagram illustrating an example apparatus according to an embodiment of the invention.

FIG. 3 is a block diagram illustrating an example apparatus 300 according to an embodiment of the invention. FIG. 3 is a schematic overview of the algorithm presenting the hierarchy of rules and logic. The upper path generates an indication of voice or onset energy from a set of features calculated on a short term segment of the audio input (a block or frame). The lower path uses an aggregation of such features and the additional creation of statistics from these features across a larger interval (several blocks or frames, or online averaging). The rule using these features is used to indicate the presence of voice, with some latency, and this is used for continuation of transmission and the indication of events associated with a nuisance condition (transmission commencement without subsequent specific voice activity). The final block uses these two sets of inputs to determine the transmission control and instantaneous gain to apply to each block.

As illustrated in FIG. 3, transform and bands block 301 utilizes a frequency based transform and a set of perceptually spaced bands for representing the signal spectral power. An initial block size or sampling of the transform subband for voice is for example in the range of 8 to 160 ms with a value of 20 ms useful in one particular embodiment.

The blocks 302, 303, 305 and 306 are used for feature extraction.

The onset decision block 307 involves the combination of features extracted primarily from the present block. This use of the short term features is to achieve a low latency for onset. It is envisaged that in some applications a slight delay in the onset decision (one or two blocks) could be tolerated to improve the decision specificity of the onset detection. In one preferred embodiment there is no delay introduced in this way.

The noise model 304 effectively aggregates a longer term feature of the input signal, however this is not used directly. Rather the instantaneous spectra in bands is compared against the noise model to create an energy measure.

In some embodiments, it is possible to take the present input spectra and the noise model in a set of bands, and produce a scaled parameter between 0 and 1 that represents the extent to which a set of bands are greater than the identified noise floor. The following is an example useful as a feature:

$$T = \frac{\sum_{n=1}^{N} \max(0, Y_n - \alpha W_n)/(Y_n + S_n)}{N} \quad (1)$$

where N is the number of bands, $Y_n$ represents the current input band powers and $W_n$ represents the current noise model. The parameter $\alpha$ is an oversubtraction factor for the noise, with an example range of 1 to 100, and in one embodiment, a value of 4 may be used. The parameter $S_n$ is a sensitivity parameter that may be different for each band, and sets a threshold of activity for this feature below which the input will not register in this feature. In some embodiments, a value of $S_n$ being around 30 dB below the expected voice level may be used, with a range of −Inf dB to −15 dB. In some embodiments, multiple versions of this T feature are calculated with different noise oversubtration ratios and sensitivity parameters. This example formula (1) is provided as a suitable feature for some embodiments, and many other variants of adaptive energy threshold could be envisaged by one skilled in the art.

In this feature, as is illustrated, use is made of a longer term noise estimator. In some embodiments, the noise estimate is controlled by an estimate of voice activity, onset or transmission resultant from the apparatus. In this case, the noise update is reasonably carried out when there is no signal activity detected and therefore no transmission suggested.

In other embodiments, the above approach can create a circularity in the system and therefore it may be preferable to use an alternative means of identifying noise segments and updating the noise model. Some applicable algorithms are the class of minimum followers (Martin, R. (1994). Spectral Subtraction Based on Minimum Statistics. EUSIPCO 1994.) A further suggested algorithm is known as Minima Controlled Recursive Averaging (I. Cohen, "Noise Spectrum estimation in adverse environments: improved minima controlled recursive averaging". IEEE Trans. Speech Audio Process. 11 (5), 466-475, 2003.)

Block 308 is responsible for collecting, filtering or aggregating the data from the short features associated with a single block, to create a set of features and statistics that are then used again as features to an additional trained or tuned rule. In an example, it is possible to stack the data and mean and variance. It is also possible to use online statistics (Infinite Impulse Response IIR for MEAN and VARIANCE).

Using the aggregated features and statistics, block 309 is used to create a delayed decision about the presence of voice across a larger region of audio input. An example size for the frame or time constant of the statistics is of the order of 240 ms, with values in the range of 100 to 2000 ms being applicable. This output is used to control the continuation or completion of a frame of audio based on the presence or absence of voice after the initial onset. This functional block is more specific and sensitive than the onset rule, as it is afforded the latency and additional information in the aggregated features and statistics.

The onset detection rule, in one embodiment is obtained using a representative set of training data and a machine learning process to create an appropriate combination of the features. In one embodiment the machine learning process utilized is adaptive boost (Freund, Y. and R. E. Schapire (1995). *A Decision-Theoretic Generalization of on-Line Learning and an Application to Boosting*), in other embodiments the use of support vector machines is considered (SCHOLKOPF, B. and A. J. SMOLA (2001). *Learning with Kernels: Support Vector Machines, Regularization, Optimization, and Beyond*. Cambridge, Mass., MIT Press). The onset detection is tuned to have an appropriate balance of sensitivity, specificity or false alarm rate, with attention paid in particular to the extent of onset or Front Edge Clipping (FEC).

Block 310 determines the overall decision to transmit, and additionally outputs a gain at each block to be applied to the outgoing audio. The gain is present to achieve one or more of two functions:

- To achieve natural voice phrasing where the signal returns to silence before and after the identified voice segment. This involves a degree of fading in (usually on the order of 20-100 ms) and a degree of fading out (usually in the order of 100-2000 ms). In one embodiment a fade in of 10 ms (or single block) and a fade out of 300 ms can be effective.
- To reduce the impact of transmitted frames that occur in the nuisance condition, where it is likely, due to recent accumulated statistics, that the voice frame onset detection is associated with an unvoiced non-stationary noise event or other disturbance.

Figure 4:
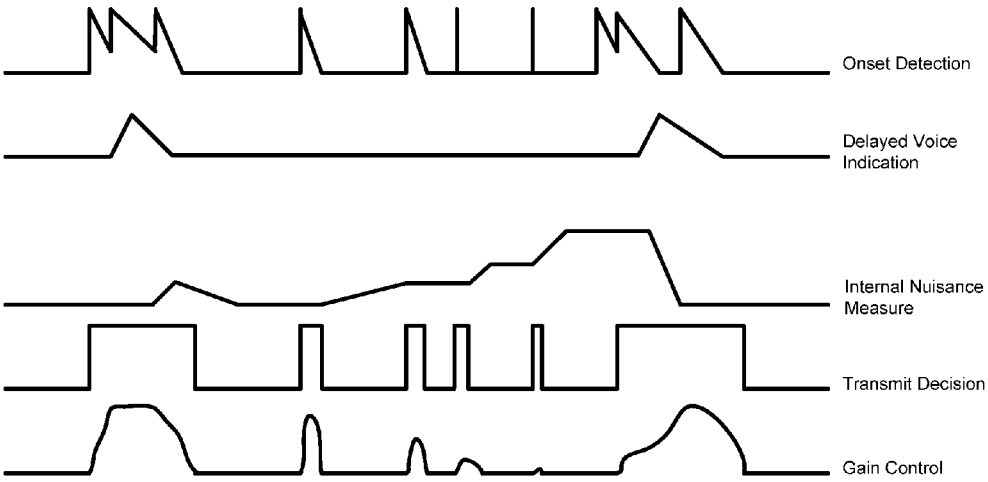
FIG. 4 is a schematic signal diagram for a specific embodiment of the Control or Combination Logic.

FIG. 4 is a schematic signal diagram for a specific embodiment of the Control or Combination Logic 310. An example of the onset framing and gain trajectory for a sample of speech input at a conferencing end point is illustrated in FIG. 4. The output of the onset detection and voice detection blocks are illustrated, along with a resulting transmission control (binary) and gain control (continuous) for an embodiment.

In FIG. 4, the inputs from the onset and voice detection functional blocks are illustrated, with the resulting output transmission decision (binary) and applied block gain (continuous). Also illustrated is an internal state variable that represents the presence or condition of 'nuisance'. The initial talk burst contains definite speech activity and is handled with a normal phrasing. The second burst is handled with a similar onset and short fade in, however lack of any voice indication is inferred as an aberrant transmission and used to increase the nuisance state measure. Several additional short transmissions further increase the nuisance state, and in response, the gain of the signal in these transmitted frames is decreased. The threshold of onset detection for a transmission to commence may also be increased. The final frame has a low gain until the voice indication occurs at which point the nuisance state is rapidly decreased.

It should be noted that in addition to the features themselves, the associated length of any talk burst or transmission precipitated from an onset event above threshold can be used as an indicative feature. Short irregular and impulsive transmission bursts are typically associated with an non stationary noise or undesirable disturbance.

As illustrated in FIG. 3, the control logic 310 may also make additional use of the activity, signal, or features derived from the far end. In one embodiment, of particular interest is the presence of significant signal on the incoming signal or far end activity. In such cases, activity at the local endpoint is more likely to represent nuisance, particularly if there is no pattern or associated relationship that would be expected of a natural conversation or voice interaction. For example, voice onset should occur after or near the end of activity from the far end. Short bursts occurring where the far end is of significant and continued voice activity may indicate a nuisance condition.

Figure 5A:
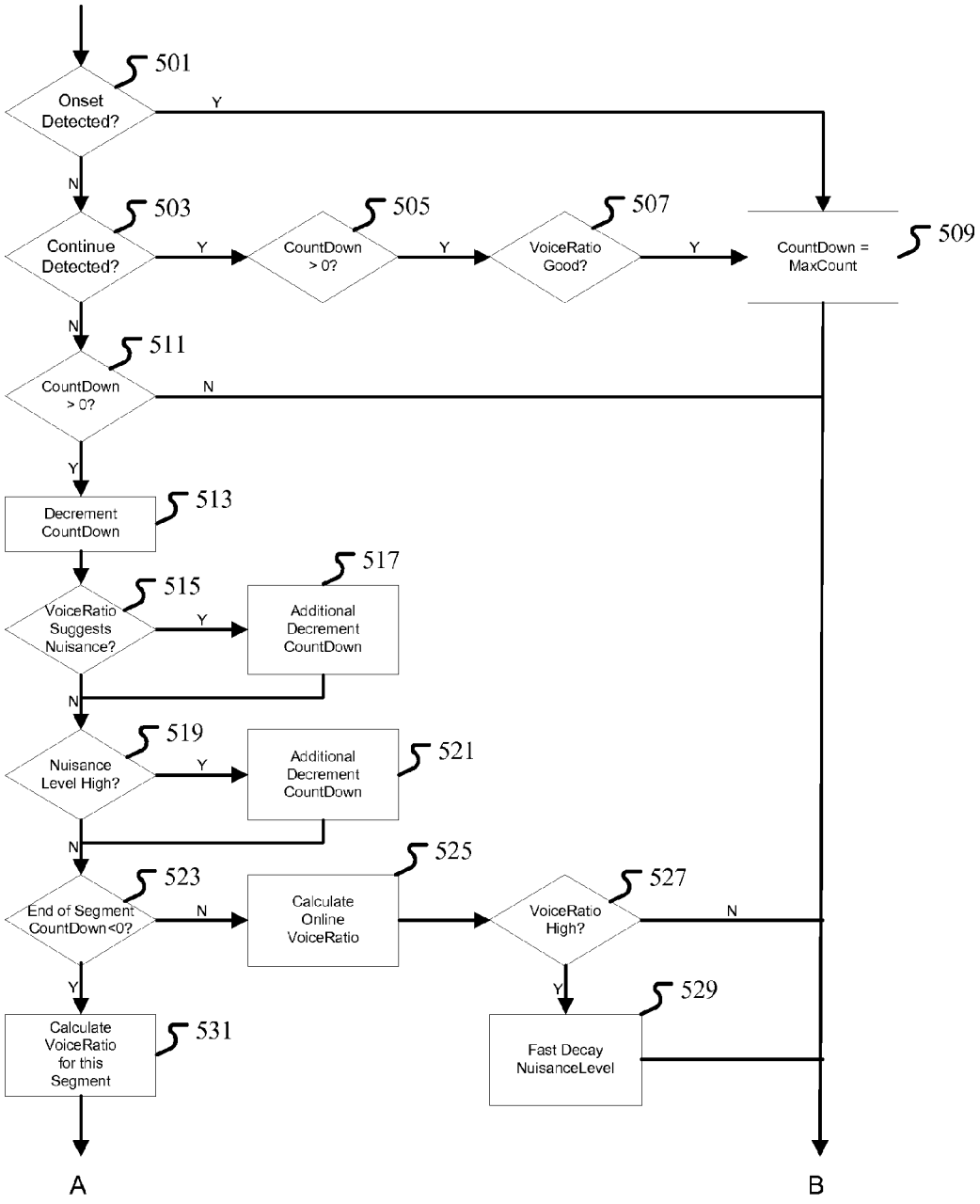
FIG. 5A and FIG. 5B depicts a flowchart illustrating the logic for creating the internal NuisanceLevel and control of the transmission flag according to an embodiment of the present invention.
Figure 5B:
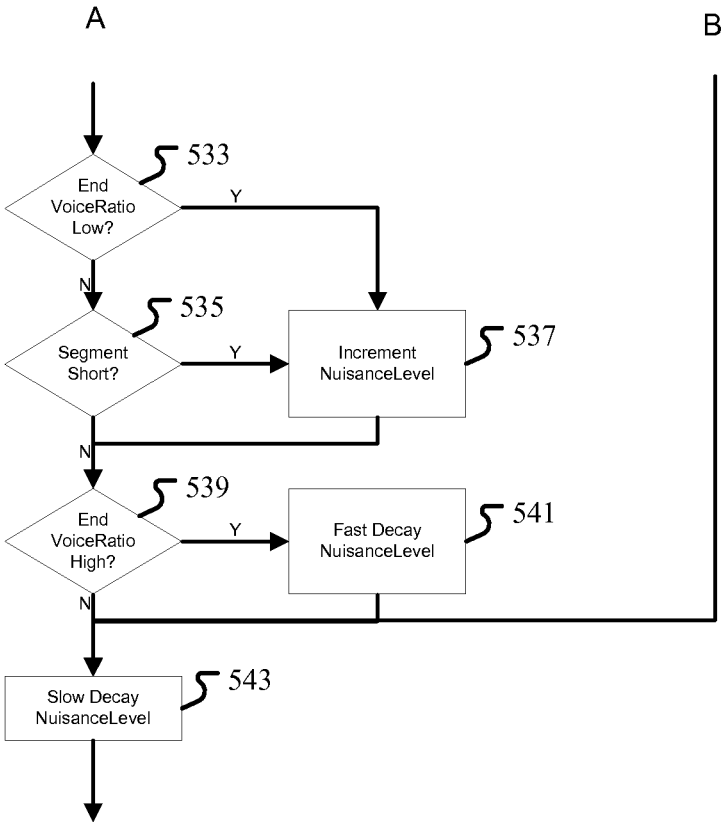

FIG. 5A and FIG. 5B depicts a flowchart illustrating the logic for creating the internal NuisanceLevel and control of the transmission flag according to an embodiment of the present invention.

As illustrated in FIG. 5A and FIG. 5B, at step 501, it is determined whether onset is detected. If yes, the process goes to step 509. If no, the process goes to step 503.

At step 503, it is determined whether continuation is detected. If yes, the process goes to step 505. If no, the process goes to step 511.

At step 505, it is determined whether variable CountDown>0. If yes, the process goes to step 507. If no, the process ends.

At step 507, it is determined whether variable VoiceRatio is good according to a certain criterion. If yes, the process goes to step 509. If no, the process ends.

At step 509, set CountDown=MaxCount. Then the process goes to step 543.

At step 511, it is determined whether CountDown>0. If yes, the process goes to step 513. If no, the process goes to step 543.

At step 513, variable CountDown is decremented. Then the process goes to step 515.

At step 515, it is determined whether variable VoiceRatio suggests nuisance. If yes, the process goes to step 517. If no, the process goes to step 519.

At step 517, an additional decrement is applied to variable CountDown. Then the process goes to step 519.

At step 519, it is determined whether variable NuisanceLevel is high according to a certain criterion. If yes, the process goes to step 521. If no, the process goes to step 523.

At step 521, an additional decrement is applied to variable CountDown. The process goes to step 523.

At step 523, it is determined whether it is the end of segment (CountDown<=0). If yes, the process goes to step 531. If no, the process goes to step 525.

At step 525, variable VoiceRatio is updated with a voice ratio calculated online. Then the process goes to step 527.

At step 527, it is determined whether variable VoiceRatio is high according to a certain criterion. If yes, the process goes to step 529. If no, the process goes to step 543.

At step 529, variable NuisanceLevel is decayed at a rate faster than increasing. Then the process goes to step 543.

At step 531, variable VoiceRatio is updated with a voice ratio calculated for the present segment. Then the process goes to step 533.

At step 533, it is determined whether variable VoiceRatio is low according to a certain criterion. If yes, the process goes to step 537. If no, the process goes to step 535.

At step 535, it is determined whether the present segment is short according to a certain criterion. If yes, the process goes to step 537. If no, the process goes to step 539.

At step 537, variable NuisanceLevel is incremented. Then the process goes to step 539.

At step 539, it is determined whether variable VoiceRatio is high. If yes, the process goes to step 541. If no, the process goes to step 543.

At step 541, variable NuisanceLevel is decayed at a rate faster than increasing. Then the process goes to step 543.

At step 543, variable NuisanceLevel is decayed at a rate slower than step 529 and step 541.

In the embodiment illustrated in FIG. 5A and FIG. 5B, each block of voice is 20 ms long, and the flow chart represents the decisions and logic that are carried out for each block. In this exemplary embodiment, the Onset Detection outputs a confidence or measure of the likelihood of desired voice activity with a low latency and thus some uncertainty. A certain threshold is set for the Onset event, whilst a lower threshold is set for the Continue event. A reasonable value for the Onset threshold corresponded to around a 5% false alarm rate on a test data set, whilst the Continue threshold corresponded to a 10% false alarm rate. In some embodiments, these two thresholds may be the same, and generally will range from 1% to 20%.

In this embodiment, there is additional variables that are used to accumulate the length of any talk burst or speech segment, and additionally keep track of the number of blocks in any burst that are flagged as Voice by the delayed classifier. The flowchart shows primarily the logic around the accumulation and use of the Nuisance Level which is a part of this disclosure.

In one embodiment, the following values and criteria for the thresholds and state updates are used:

| | |
|---|---|
| MaxCount | 10 (200 ms hold over at 20 ms block) |
| VoiceRatio Good | >20% Voice required to allow a Continue |
| VoiceRatio Suggests Nuisance | <20% Voice applies additional decrement |
| Nuisance Level High | >0.6 Nuisance applies additional decrement |
| VoiceRatio High | >60% Voice applies fast decay of NuisanceLevel |
| EndVoiceRatio Low | <20% Voice at segment end increments Nuisance |
| Segment Short | Shorter than 1s increments NuisanceLevel |
| EndVoiceRatio High | >60% Decay Nuisance Level |

Additional tuning parameters relate to the accumulation and decay of the NuisanceLevel. In one embodiment, the NuisanceLevel ranges from 0 to 1. The events of a short talk burst, or a talk burst with low detected speech activity cause an increment of the Nuisance level by 0.2. During a talk burst, if a high level of voice (>60%) speech is detected, the NuisanceLevel is set to decay with a 1 s time constant. At the end of a talk burst with a high level of voice (>60%) the Nuisance level is halved. In all cases the NuisanceLevel is set to decay with a 10 s time constant. These values are suggestive, and it should be evident to one skilled in the art that an amount of variation or tuning around such values would be applicable to different applications.

In this way, the NuisanceLevel is increased each time there is a 'Nuisance Event', being the occurrence of a short (<1 s) talk burst, or a talk burst which is primarily not voice. As the NuisanceLevel increases, the system is more aggressive in the way that talk segments are ended with the additional decrement of the talk burst count down.

The flowchart in FIG. 5A and FIG. 5B is indicative of one embodiment, and it should be apparent that many variations of this are possible with similar effect. The aspects of this logic specific to this invention are the accumulation of the VoiceRatio and the NuisanceLevel from the observation of the talk segment lengths and ratio of voiced activity throughout and at the end of each talk segment.

In further embodiments, a set of longer term classifiers maybe trained to create outputs that reflect the presence of other signals that may be characterised as nuisance conditions. For example, a rule applied in the longer term classifier may be design to indicate the direct presence of typing activity in the input signal. The longer time frame and delay of the long term classifier allows a greater degree of specificity at this point to achieve differentiation between some nuisance signals and the desired voice input.

Such classifiers of additional Nuisance signal categories can be used to increment the NuisanceLevel at specific events of the disturbance occurrence, the end of a talk burst containing such a disturbance, or alternatively at a rate of increase over time that is fixed and applied during intervals where the detection of the disturbance or ratio of the detected disturbance exceeds some threshold.

Given the embodiments of the invention described above, it should be apparent to those skilled in the art that the additional classifiers and information regarding the system stage can be used to decide additional nuisance events and appropriately increment the nuisance level. Whilst not a requirements, it is convenient that the NuisanceLevel range from 0 to 1, with 0 representing a low probability of nuisance associated with an absence of recent nuisance events, and 1 representing a high probability of nuisance associated with the presence of recent nuisance events.

In general embodiments, the NuisanceLevel is used to apply an additional attenuation to the output signal transmitted. In one embodiment, the following expression is used to calculate the gain $$\text{Gain} = 10^{\frac{NuisanceLevel*NuisanceGain}{20}}$$

where in one embodiment a value of NuisanceGain=−20 is used with a suitable range of the gain during nuisance being effectively 0 . . . −100 dB. As the NuisanceLevel increases, this expression applies a gain (or an effective attenuation) that represents a reduction in the signal in dB that is linearly related to the NuisanceLevel.

In some embodiments, an additional phrasing gain is applied to create softer transitions at the end of the talk segment to the background level or silence required in between talk bursts. In the example embodiment, the CountDown for a talk burst is set to 10 at the detection of an Onset or appropriate Continue, and is decremented as the talk burst continues (with faster decrement applied when NuisanceLevel is high or the VoiceRatio is low). This CountDown is used directly to index a table which contains a set of gains. As the CountDown is decreased past a certain point, this table effects a gradual fade out of the output signal. In one embodiment, where the CountMax is equivalent to 10 blocks at 20 ms, or a 200 ms hold over, the following fadeout table is used to fade to zero outside of a talk burst

[0 0.0302 0.1170 0.2500 0.4132 0.5868 0.7500 0.8830 0.9698 1 1]

This represents an approximately 60 ms hold over with no reduction in gain, and then a raised cosine fade to zero. It should be apparent to those skilled in the art that there are a large number of possible fade out lengths and curves that would be suitable, and this represents a single useful example. It should also be apparent the benefit in the fade to zero to correspond with the termination of transmission, and that the overall transmit decision in this example can be represented simply as Transmit=true, if CountDown>0; or False if otherwise, The previous text contains sufficient definition of a suggested embodiment that would run with a 20 ms block size on incoming audio. FIG. 4 sets out a schematic set of signals for the operation of such a system illustrating the most pertinent signals and the output of the logic in terms of the NuisanceLevel, Transmit decision and applied Gain.

Figure 6:
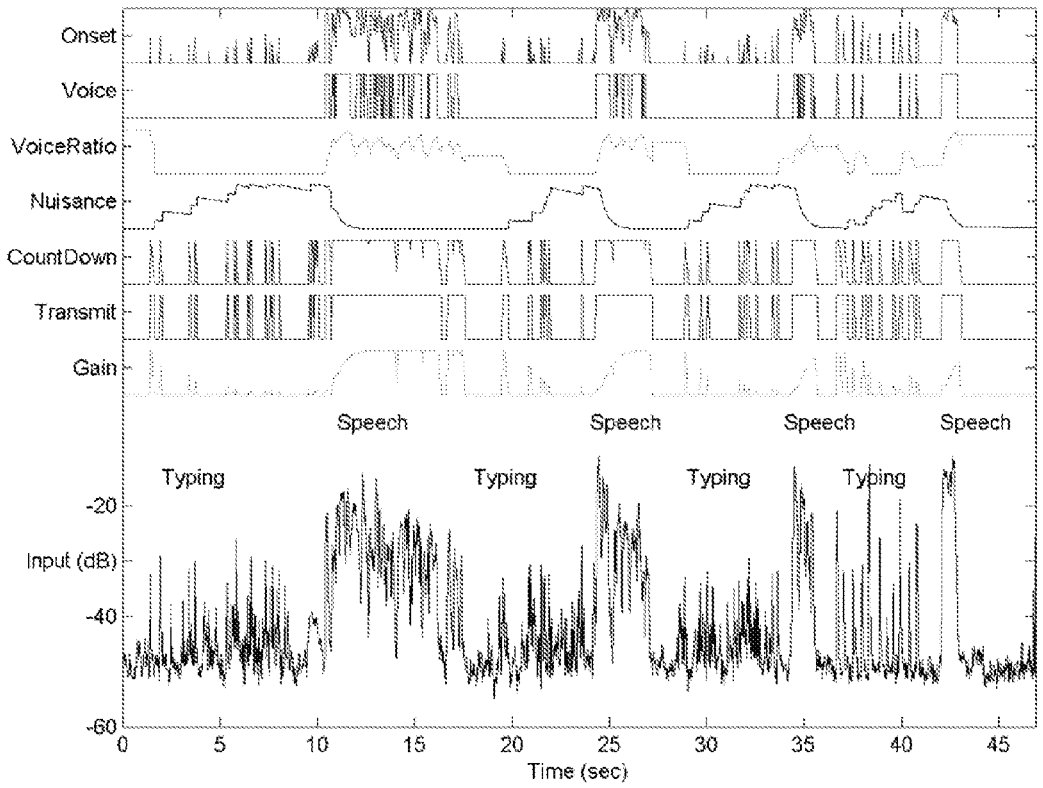
FIG. 6 is a plot illustrating internal signals which occur during processing a section of audio containing desired speech segments interleaved with typing (nuisance)

FIG. 6 is a plot illustrating internal signals which occur during processing a section of audio containing desired speech segments interleaved with typing (nuisance).

Figure 7:
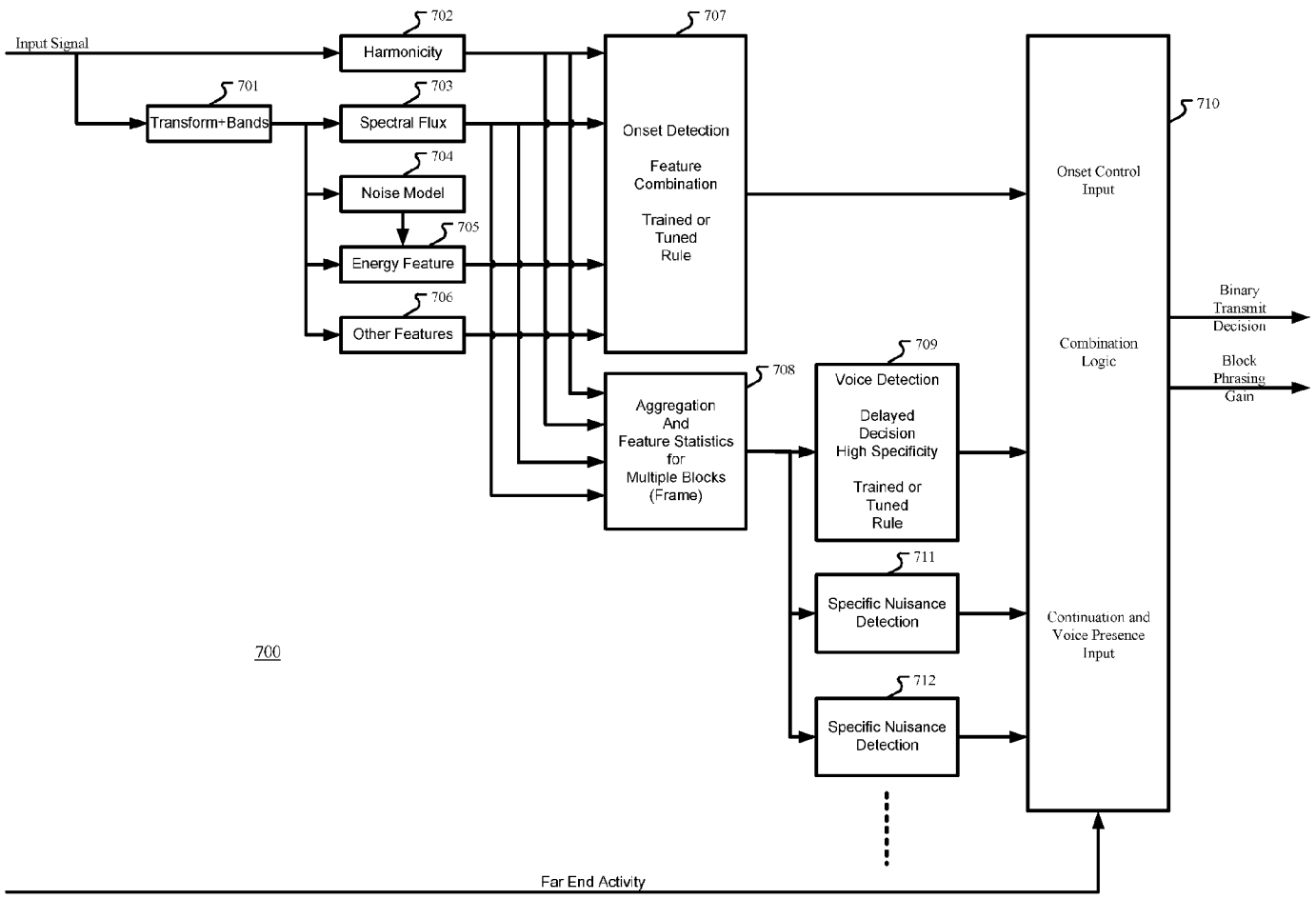
FIG. 7 is a block diagram illustrating an example apparatus according to an embodiment of the invention.

FIG. 7 is a block diagram illustrating an example apparatus 700 according to an embodiment of the invention. In FIG. 7, the apparatus 700 is a transmit control system with the addition of a set of specific classifiers targeted to identify particular nuisance types.

In FIG. 7, blocks 701 to 709 have the same function as blocks 301 to 309 respectively, and will not be described in detail here.

In the previous embodiments, the detection of nuisance is primarily derived from the activity of the onset detection and some accumulated statistics from the delayed specific voice activity detection. In some embodiments, additional classifiers may be trained and incorporated to identify specific types of nuisance condition. Such a classifier could use the features as already present for the onset and voice detection classifiers with a separate rule trained to have moderate sensitivity and high specificity for specific nuisance conditions. Some examples of nuisance audio that may be effectively identified by a trained module may include Breathing
Cell phone ring tones
PABX or similar hold music
Music
Cell phone RF interference Such classifiers would be used in addition to the indicators detailed above to increase the estimated probability of nuisance. For example, the detection of a mobile phone RF interference persisting more than is could quickly saturate the nuisance parameter. Each nuisance type may have a different effect and logic for interaction with other state and the nuisance value. Generally, the indication of a nuisance presence from a specific classifier would increase the nuisance level to a maximum within 100 ms to 5 s and/or 2-3 repeated occurrences of that same nuisance without any normal voice activity detected.

In the design of such classifiers, the aim is to achieve moderate sensitivity to the nuisance with a suggestion of 30 to 70% and therefore ensuring a high specificity to avoid false alarms. It would be expected that for typical voice and conference activity not containing a particular nuisance type, the false alarm rate would be such that false alarms occur no more frequently than every minute or so of typical activity (with a range of false alarm time from 10 s to 20 m being reasonable for some designs).

In FIG. 7, the additional classifiers 711 and 712 are used as inputs into the decision logic 710.

In all previous embodiments, a functional block 306 or 706 is illustrated for 'Other Features' feeding into the classifiers. In some embodiments, a particular feature of use is the normalized spectra of the input audio signal. The signal energy is calculated over a set of bands, which may be perceptually spaced, and normalized such that the signal level dependence is removed from this features. In some embodiments, a set of around 6 bands are used, with a number from 4 to 16 being reasonable. This feature is useful for providing an indication of the spectral bands that dominate the signal at any point in time. For example, it is generally learnt from a classifier that when the lowest bands, representing frequencies below say 200 Hz, dominate the spectra, then the likelihood of voice is lower since such high noise levels can otherwise falsely trigger the signal detection.

Another feature that is useful in some embodiments, particularly for the onset detection, is the absolute energy of the signal. A suitable feature in some embodiments is a simple root mean square RMS measure, or a weighted RMS measure across the expected frequency range of highest voice signal to noise ratio, typically being around 500 Hz to 4 kHz. Depending on the presence of leveling or a priori knowledge of desired voice level in the input signal, the absolute level can be an effective features and used appropriately in any model training.

Figure 8:
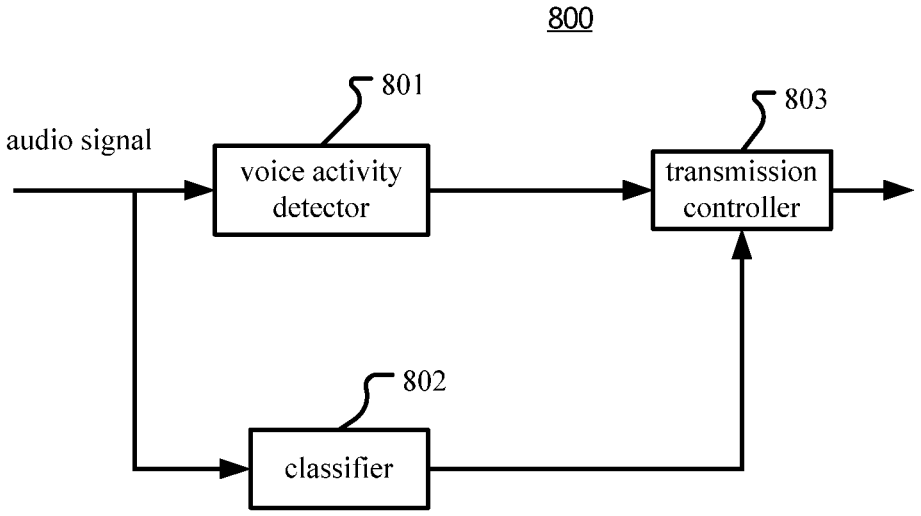
FIG. 8 is a block diagram illustrating an example apparatus for performing signal transmission control according to an embodiment of the invention.

FIG. 8 is a block diagram illustrating an example apparatus 800 for performing signal transmission control according to an embodiment of the invention.

As illustrated in FIG. 8, the apparatus 800 includes a voice activity detector 801, a classifier 802 and a transmission controller 803.

The voice activity detector 801 is configured to perform a voice activity detection on each present frame of an audio signal based on short-term features extracted from the present frame. The function of extracting the short-term features may be included in the voice activity detector 801, or in another component of the apparatus 800.

Various short-term features may be used for the voice activity detection. Examples of the short-term features include, but not limited to harmonicity, spectral flux, noise model, and energy feature. The onset decision may involve the combination of features extracted from the present frame. This use of the short term features is to achieve a low latency for onset detection. However, in some applications, a slight delay in the onset decision (one or two frames) may be tolerated to improve the decision specificity of the onset detection, and therefore, the short-term features may be extracted from more than one frame.

In case of the energy feature, a noise model may be used to aggregate a longer term feature of the input signal, and instantaneous spectra in bands are compared against the noise model to create an energy measure.

In an example, it is possible to derive the present input spectra and the noise model in a set of bands, and produce a scaled parameter between 0 and 1 that represents the extent to which a set of bands are greater than the identified noise floor. In this case, the feature T as described in formula (1) may be used.

In some embodiments, the noise estimate may be controlled by a transmission decision from the classifier 802 and the transmission controller 803 (will be described in detail in the following) respectively. In this case, the noise update may be carried out when it is determined there is no transmission performed.

In some other embodiments, it is possible to use an alternative means of identifying noise segments and updating the noise model. Some example algorithms include Minimum Followers described in Martin, R., "Spectral Subtraction Based on Minimum Statistics," EUSIPCO 1994, Minima Controlled Recursive Averaging described in I. Cohen, "Noise Spectrum estimation in adverse environments: improved minima controlled recursive averaging," IEEE Trans. Speech Audio Process. 11 (5), 466-475, 2003.

The result of the voice activity detection performed by the voice activity detector 801 includes onset decision such as onset-start event, onset-continuation event and non-onset event. The onset-start event occurs in a frame when voice onset can be detected from the frame and no voice onset can be detected from one or more its preceding frames. The onset-continuation event occurs in a frame when an onset-start event has occurred in its immediate preceding frame and a voice onset can be detected from the frame with a lower energy threshold than that for detecting the onset-start event from the preceding frame. The non-onset event occurs in a frame when no voice onset can be detected from the frame.

In an embodiment, the onset detection rule used by the voice activity detector 801 may be obtained by using a representative set of training data and a machine learning process to create an appropriate combination of the features. In an example, the machine learning process utilized is adaptive boost. In another example, support vector machines may be used. The onset detection may be tuned to have an appropriate balance of sensitivity, specificity or false alarm rate, with attention paid in particular to the extent of onset or Front Edge Clipping (FEC).

For each present frame, the transmission controller 803 is configured to identify the present frame as the start of a present voice segment if an onset-start event is detected from the present frame. The present voice segment is initially assigned an adaptive length L not smaller than a holdover length. The voice segment is a sequence of frames corresponding to speech activity between two periods including no speech activity. If an onset-start event occurs in a present frame, it can be anticipated that the present frame may be the start of a possible voice segment including a speech activity, and the following frames, although not processed yet, may be parts of the speech and be included in the voice segment. However, at the time of processing the present frame, the final length of the voice segment is unknown. Therefore, it is possible to define an adaptive length for the voice segment and adjust (increase or reduce) the length according to the information (will be described in detail in the following) obtained at time of processing the following frames.

If the present frame is within the present voice segment, the classifier 802 is configured to perform a voice/non-voice classification on the present frame based on long-term features extracted from the frames, to derive a measure of the number of frame classified as voice in the present frame. The function of extracting the long-term features may be included in the classifier 802, or in another component of the apparatus 800. In a further embodiment, the long-term features may include the short-term features used by the voice activity detector 801. In this way, the short-term features extracted from more than one frame may be accumulated to form the long-term features. Further, the long-term features may also include statistics on the short-term features. Examples of the statistics include, but not limited to, mean and variance of the short-term features. If the present frame is classified as voice, the derived measure is 1, and if otherwise, the derived measure is 0.

Because the classifier 802 classifies the present frame based on the long-term features extracted from a larger region including more than one frame, the decision made by the classifier 802 is a delayed decision about the presence of voice across the larger region (including the present frame) of audio input. This decision is certainly can be regarded as the decision about the present frame. An example size for the larger region or time constant of the statistics may be of the order of 240 ms, with values in the range of 100 to 2000 ms.

The decision made by the classifier 802 may be used by the transmission controller 803 to control the continuation (increasing the adaptive length) or completion (reducing the adaptive length) of a present voice segment based on the presence or absence of voice after the initial onset. Specifically, if the present frame is within the present voice segment, the transmission controller 803 is further configured to calculate a voice ratio of the present frame as a moving average of the measures. Examples of the moving average algorithm include, but not limited to, simple moving average, cumulative moving average, weighted moving average and exponential moving average. In case of exponential moving average, the voice ratio VRn of frame n may be calculated as $VRn=\alpha VRn-1+(1-\alpha)Mn$, where VRn−1 is the voice ration of frame n−1, Mn is the measure of frame n, and a is a constant between 0 and 1. The voice ratio represents a prediction made at the time of the present frame, about a possibility that the next frame includes voice.

If an onset-continuation event is detected from the present frame n and the voice ratio VRn−1 of an immediately previous frame n−1 relative to the present frame n is greater than a threshold VoiceNuisance (e.g., 0.2), this means that frame n is likely to include voice, and therefore, the transmission controller 803 increases the adaptive length. If the voice ratio is below the threshold VoiceNuisance, frame n is likely to be in a nuisance condition. The term "nuisance" refers to an estimate of the probability that signal activity in the next frame, which would normally be anticipated as voice, is likely to be of an undesirable nature—for example, short bursts, keyboard activity, background speech, non-stationary noise etc. Such an undesirable signal usually does not exhibit a higher voice ratio. A higher voice ratio indicates a higher possibility of voice, and therefore, the present voice segment is likely to be longer than what is estimated before the present frame. Accordingly, the adaptive length may be increased, for example, by one or more frames. The threshold VoiceNuisance may be determined based on a tradeoff between the sensitivity to the nuisance and the sensitivity to the voice.

If a non-onset event is detected from the present frame n and the voice ratio VRn−1 of the immediately previous frame n−1 is less than the threshold VoiceNuisance, this mean that frame n is likely to be in a nuisance condition, and the transmission controller 803 reduces the adaptive length of the present voice segment. In this case, the present frame is included in the reduced adaptive length, that is, the reduced voice segment is not shorter than the portion from the start frame to the present frame.

For each of the frames, the transmission controller 803 is configured to determine to transmit the frame or not to transmit the frame if the frame is or is not included in one of the voice segments.

It can be understood that, the start of the voice segments is determined based on the onset-start event which is detected based on the short-term features, and the continuation and the completion of the voice segments is determined based on the voice ratio which is estimated based on the long-term features. Therefore, the benefits of low latency and low false alarms can be achieved.

Figure 9:
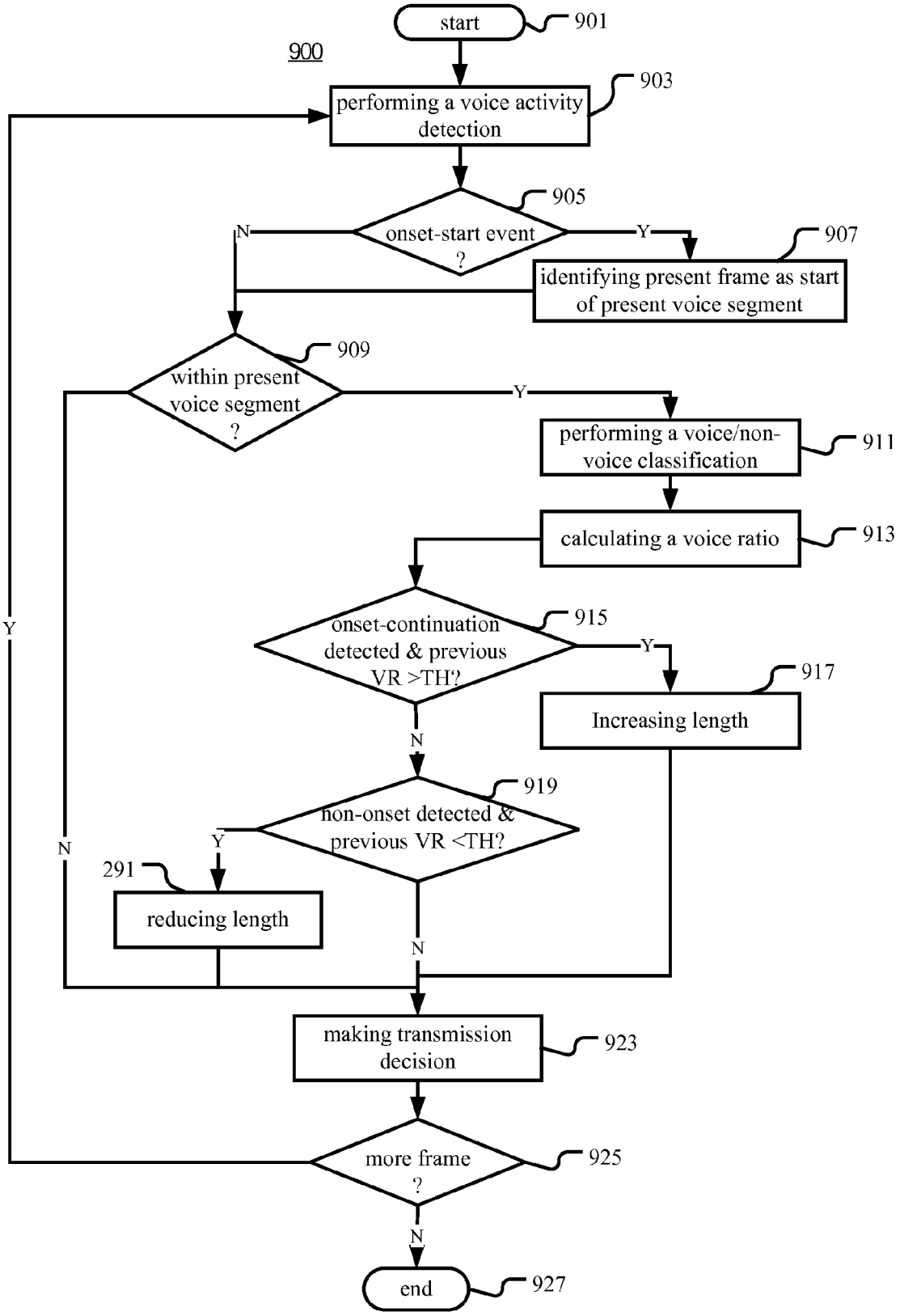
FIG. 9 is a flow chart illustrating an example method of performing signal transmission control according to an embodiment of the invention.

FIG. 9 is a flow chart illustrating an example method 900 of performing signal transmission control according to an embodiment of the invention.

As illustrated in FIG. 9, the method 900 starts from step 901. At step 903, a voice activity detection is performed on a present frame of an audio signal based on short-term features extracted from the present frame.

At step 905, it is determined whether an onset-start event is detected from the present frame. If an onset-start event is detected from the present frame, at step 907, the present frame is identified as the start of a present voice segment, and the present voice segment is initially assigned an adaptive length not smaller than a holdover length. Then the method 900 proceeds to step 909. If an onset-start event is not detected from the present frame, the method 900 proceeds to step 909.

At step 909, it is determined whether the present frame is within the present voice segment. If the present frame is not within the present voice segment, the method 900 proceeds to step 923. If the present frame is within the present voice segment, at step 911, a voice/non-voice classification is performed on the present frame based on long-term features extracted from the frames, to derive a measure of the number of frame classified as voice in the present frame. In a further embodiment, the long-term features may include the short-term features used at step 903. In this way, the short-term features extracted from more than one frame may be accumulated to form the long-term features. Further, the long-term features may also include statistics on the short-term features.

At step 913, a voice ratio of the present frame is calculated as a moving average of the measures.

At step 915, it is determined whether an onset-continuation event is detected from the present frame n and the voice ratio VRn−1 of an immediately previous frame n−1 relative to the present frame n is greater than a threshold VoiceNuisance (e.g., 0.2). If an onset-continuation event is detected from the present frame n and the voice ratio VRn−1 of an immediately previous frame n−1 relative to the present frame n is greater than a threshold VoiceNuisance (e.g., 0.2), at step 917, the adaptive length is increased. Then the method 900 proceeds to step 923. If otherwise, at step 919, it is determined whether a non-onset event is detected from the present frame n and the voice ratio VRn−1 of the immediately previous frame n−1 is less than the threshold VoiceNuisance. If a non-onset event is detected from the present frame n and the voice ratio VRn−1 of the immediately previous frame n−1 is less than the threshold VoiceNuisance, at step 921, the adaptive length of the present voice segment is reduced, and then the method 900 proceeds to step 923. If otherwise, the method 900 proceeds to step 923.

At step 923, it is determined to transmit the frame or not to transmit the frame if the frame is or is not included in one of the voice segments.

At step 925, it is determined whether there is another frame to be processed. If yes, the method 900 returns to step 903 to process the other frame, and if no, the method 900 ends at step 927.

In a further embodiment of the apparatus 800, the audio signal is associated with a nuisance level NuisanceLevel indicating the possibility that a nuisance state exists at the present frame. If a non-onset event is detected from the present frame n, the present frame n is the last frame of the present voice segment and the voice ratio VRn−1 of the immediately previous frame n−1 is less than the threshold VoiceNuisance, the transmission controller 803 is further configured to increase the nuisance level NuisanceLevel with a first rate NuisanceInc (e.g., plus 0.2). In case that the present frame is within the present voice segment, if the voice ratio VRn of present frame n is greater than a threshold VoiceGood (e.g., 0.4) and the portion of the present voice segment from the start to the present frame is longer than a threshold VoiceGoodWaitN, the transmission controller 803 is further configured to reduce the nuisance level NuisanceLevel with a second rate NuisanceAlphaGood (e.g., multiplied by 0.5) faster than the first rate. If the voice ratio VRn of present frame n is greater than the threshold VoiceGood, this means that the next frame is more likely to include voice. In this consideration, it is preferable that the threshold VoiceGood is higher than the threshold VoiceNuisance. If the portion of the present voice segment from the start to the present frame is longer than the threshold VoiceGoodWaitN, this means that the higher voice ratio has been maintained for a period of time. Meeting these two conditions means that the present voice segment is more likely to include voice activity, and thus the nuisance level should be reduced quickly.

In an example, it is convenient that the NuisanceLevel range from 0 to 1, with 0 representing a low probability of nuisance associated with an absence of recent nuisance events, and 1 representing a high probability of nuisance associated with the presence of recent nuisance events.

If it is determined to transmit the present frame, the transmission controller 803 is further configured to calculate a gain applied to the present frame as a monotonically decreasing function of the nuisance level NuisanceLevel. The NuisanceLevel is used to apply an additional attenuation to the output signal transmitted. In an example, the following expression is used to calculate the gain $$\text{Gain} = 10^{\frac{NuisanceLevel*NuisanceGain}{20}}$$

where in an example, a value of NuisanceGain=−20 is used, with a suitable range of the gain during nuisance being effectively 0 . . . −100 dB. As the NuisanceLevel increases, this expression applies a gain (or an effective attenuation) that represents a reduction in the signal in dB that is linearly related to the NuisanceLevel.

In a further embodiment of the method 900, the audio signal is associated with a nuisance level NuisanceLevel indicating the possibility that a nuisance state exists at the present frame. In the method 900, if a non-onset event is detected from the present frame n, the present frame n is the last frame of the present voice segment and the voice ratio VRn−1 of the immediately previous frame n−1 is less than the threshold VoiceNuisance, the nuisance level NuisanceLevel is increased with a first rate NuisanceInc (e.g., plus 0.2). In case that the present frame is within the present voice segment, if the voice ratio VRn of present frame n is greater than the threshold VoiceGood (e.g., 0.4) and the portion of the present voice segment from the start to the present frame is longer than the threshold VoiceGoodWaitN, the nuisance level NuisanceLevel is reduced with the second rate NuisanceAlphaGood (e.g., multiplied by 0.5) faster than the first rate. If it is determined to transmit the present frame, a gain applied to the present frame is calculated as a monotonically decreasing function of the nuisance level NuisanceLevel. The NuisanceLevel is used to apply an additional attenuation to the output signal transmitted.

In further embodiments of the apparatus 800 and the method 900, if a non-onset event is detected from the present frame n, the present frame is the last frame of the present voice segment and the voice ratio VRn−1 of the immediately previous frame n−1 is greater than a threshold VoiceGood higher than the threshold VoiceNuisance, the nuisance level NuisanceLevel is reduced with a third rate VoiceGoodDecay (e.g., multiplied by 0.5) faster than the first rate NuisanceInc. This means that if the voice ratio is higher, and thus the present frame is more likely to include voice, the nuisance level is reduced quickly. It can be seen that this kind of update to the nuisance level is perform at the end of the voice segment.

In further embodiments of the apparatus 800 and the method 900, if a non-onset event is detected from the present frame, the present frame is the last frame of the present voice segment and the length of the present voice segment is smaller than a nuisance threshold length, the nuisance level is increased with the first rate. This means that short segment is likely in the nuisance condition, and therefore, the nuisance level is increased. It can be seen that this kind of update to the nuisance level is perform at the end of the voice segment.

In further embodiments of the apparatus 800 and the method 900, if a non-onset event is detected from the present frame and the nuisance level is greater than a threshold NuisanceThresh, the adaptive length of the present voice segment is reduced, wherein the present frame is included in the reduced adaptive length. This means that if the conditions are met, the segment is more likely in the nuisance condition, and the segment should be reduced to end the transmission quickly.

In further embodiments of the apparatus 800 and the method 900, if a non-onset event is detected from the present frame and the present frame is not within the present voice segment, the nuisance level is reduced with a fourth rate NuisanceAlpha slower than the first rate.

In further embodiments of the apparatus 800 and the method 900, if a non-onset event is detected from the present frame and the present frame is the last frame of the present voice segment, the nuisance level is calculated as a quotient obtained by dividing the number of frames classified as voice in the present voice segment by the length of the present voice segment.

In further embodiments of the apparatus 800 and the method 900, the present frame is determined as within the present voice segment only if the portion of the present voice segment from the present frame to the end of the present voice segment is longer than a threshold IgnoreEndN. This means that in the ending portion defined by threshold IgnoreEndN, the processing of classification and thus the update to the voice ratio are ignored.

In a further embodiment of the apparatus 800, the apparatus 800 may further include a nuisance classifying unit configured to detect a predetermined class of signal which can cause a nuisance condition from the present frame based on long-term features extracted from the frames. In this case, the transmission controller is further configured to, if the predetermined class of signal is detected, increase the nuisance level.

In this case, additional classifiers may be trained and incorporated to identify specific types of nuisance condition. Such a classifier could use the features as already present for the voice activity detection and voice/non-voice classification with a separate rule trained to have moderate sensitivity and high specificity for specific nuisance conditions. Some examples of nuisance audio that may be effectively identified by a trained module may include Breathing, Cell phone ring tones, PABX or similar hold music, Music, Cell phone RF interference.

Such classifiers would be used in addition to the indicators detailed above to increase the estimated probability of nuisance. For example, the detection of a mobile phone RF interference persisting more than is could quickly saturate the nuisance parameter. Each nuisance type may have a different effect and logic for interaction with other state and the nuisance value. Generally, the indication of a nuisance presence from a specific classifier would increase the nuisance level to a maximum within 100 ms to 5 s and/or 2-3 repeated occurrences of that same nuisance without any normal voice activity detected.

In a further embodiment of the method 900, the method 900 may further include detecting a predetermined class of signal which can cause a nuisance condition from the present frame based on long-term features extracted from the frames, and increasing the nuisance level if the predetermined class of signal is detected.

Figure 10:
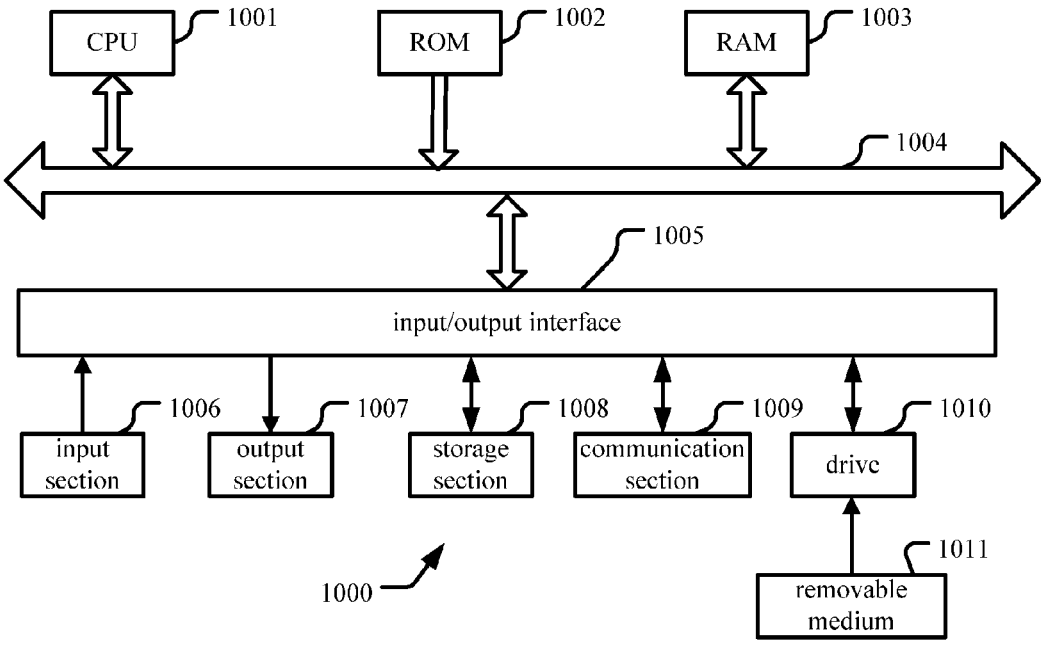
FIG. 10 is a block diagram illustrating an exemplary system for implementing embodiments of the present invention.

In FIG. 10, a central processing unit (CPU) 1001 performs various processes in accordance with a program stored in a read only memory (ROM) 1002 or a program loaded from a storage section 1008 to a random access memory (RAM) 1003. In the RAM 1003, data required when the CPU 1001 performs the various processes or the like are also stored as required.

The CPU 1001, the ROM 1002 and the RAM 1003 are connected to one another via a bus 1004. An input/output interface 1005 is also connected to the bus 1004.

The following components are connected to the input/output interface 1005: an input section 1006 including a keyboard, a mouse, or the like; an output section 1007 including a display such as a cathode ray tube (CRT), a liquid crystal display (LCD), or the like, and a loudspeaker or the like; the storage section 1008 including a hard disk or the like; and a communication section 1009 including a network interface card such as a LAN card, a modem, or the like. The communication section 1009 performs a communication process via the network such as the internet.

A drive 1010 is also connected to the input/output interface 1005 as required. A removable medium 1011, such as a magnetic disk, an optical disk, a magneto-optical disk, a semiconductor memory, or the like, is mounted on the drive 1010 as required, so that a computer program read therefrom is installed into the storage section 1008 as required.

In the case where the above-described steps and processes are implemented by the software, the program that constitutes the software is installed from the network such as the internet or the storage medium such as the removable medium 1011.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The following exemplary embodiments (each an "EE") are described.

EE 1. A method, comprising:

receiving or accessing an audio signal that comprises a plurality of temporally sequential blocks or frames;

determining two or more features that characterize aggregately two or more of the sequential audio blocks or frames that have been processed previously within a time period that is recent in relation to a current point in time, wherein the feature determination exceeds a specificity criterion and is delayed in relation to the recently processed audio blocks or frames;

detecting an indication of voice activity in the audio signal, wherein the voice activity detection (VAD) is based on a decision that exceeds a preset sensitivity threshold and that is computed over a time period, which is brief in relation to the duration of each of the audio signal blocks or frames, and wherein the decision relates to one or more features of a current audio signal block or frame;

combining the high sensitivity short term VAD, the recent high specificity audio block or frame feature determination and information that relates to a state, which is based on a history of one or more previously computed feature determinations that are compiled from a plurality of features that are determined over a time that is prior to the recent high specificity audio block or frame feature determination time period; and outputting a decision relating to a commencement or termination of the audio signal, or a gain related thereto, based on the combination.

EE 2. The method as recited in EE 1 wherein the combining step further comprises combining one or more signals or determinations that relate to a feature that comprises a current or previously processed characteristic of the audio signal.

EE 3. The method as recited in EE 1 wherein the state relates to one or more of a nuisance characteristic or a ratio of voice content in the audio signal to a total audio content thereof.

EE 4. The method as recited in EE 1 wherein the combining step further comprises combining information that relates to a far end device or audio condition, which is communicatively coupled with a device that is performing the method.

EE 5. The method as recited in EE 1, further comprising:

analyzing the determined features that characterize the recently processed audio blocks or frames;

based on the determined features analysis, inferring that the recently processed audio blocks or frames contain at least one undesired temporal signal segment; and measuring a nuisance characteristic based on the undesirable signal segment inference.

EE 6. The method as recited in EE 5 wherein the measured nuisance characteristic varies.

EE 7. The method as recited in EE 6 wherein the measured nuisance characteristic varies monotonically.

EE 8. The method as recited in one or more of EE 5, EE 6 or EE 7, wherein the high specificity previous audio block or frame feature determination comprises one or more of a ratio or a prevalence of desired voice content in relation to the undesired temporal signal segment.

EE 9. The method as recited in one or more of EE 5, EE 6, EE 7, or EE 8 further comprising computing a moving statistic that relates to the desired voice content ratio or prevalence in relation to the undesired temporal signal segment.

EE 10. The method as recited in EE 5, further comprising:

determining one or more features that identify a nuisance characteristic over the aggregate of two or more of the previously processed sequential audio blocks or frames;

wherein the nuisance measurement is further based on the nuisance feature identification.

EE 11. The method as recited in EE 1, further comprising:

controlling a gain application; and smoothing the desired temporal audio signal segment commencement or termination based on the gain application control.

EE 12. The method as recited in EE 11 wherein:

the smoothed desired temporal audio signal segment commencement comprises a fade-in; and the smoothed desired temporal audio signal segment termination comprises a fade-out.

EE 13. The method as recited in one or more of EE 3 or EE 7 through EE 6, inclusive, further comprising controlling a gain level based on the measured nuisance characteristic.

EE 14. An apparatus, comprising:

an inputting unit configured to receive or access an audio signal that comprises a plurality of temporally sequential blocks or frames;

a feature generator configured to determine two or more features that characterize aggregately two or more of the sequential audio blocks or frames that have been processed previously within a time period that is recent in relation to a current point in time, wherein the feature determination exceeds a specificity criterion and is delayed in relation to the recently processed audio blocks or frames;

a detector configured to detect an indication of voice activity in the audio signal, wherein the voice activity detection (VAD) is based on a decision that exceeds a preset sensitivity threshold and that is computed over a time period, which is brief in relation to the duration of each of the audio signal blocks or frames, and wherein the decision relates to one or more features of a current audio signal block or frame;

a combining unit configured to combine the high sensitivity short term VAD, the recent high specificity audio block or frame feature determination and information that relates to a state, which is based on a history of one or more previously computed feature determinations that are compiled from a plurality of features that are determined over a time that is prior to the recent high specificity audio block or frame feature determination time period; and a decision maker configured to output a decision relating to a commencement or termination of the audio signal, or a gain related thereto, based on the combination.

EE 15. The apparatus as recited in EE 14 wherein the combining unit is further configured to combine one or more signals or determinations that relate to a feature that comprises a current or previously processed characteristic of the audio signal.

EE 16. The apparatus as recited in EE 14 wherein the state relates to one or more of a nuisance characteristic or a ratio of voice content in the audio signal to a total audio content thereof.

EE 17. The apparatus as recited in EE 14 wherein the combining unit is further configured to combine information that relates to a far end device or audio condition, which is communicatively coupled with a device that is performing the method.

EE 18. The apparatus as recited in EE 14, further comprising a nuisance estimator configured to:

analyze the determined features that characterize the recently processed audio blocks or frames;

based on the determined features analysis, infer that the recently processed audio blocks or frames contain at least one undesired temporal signal segment; and measure a nuisance characteristic based on the undesirable signal segment inference.

EE 19. The apparatus as recited in EE 18 wherein the measured nuisance characteristic varies.

EE 20. The apparatus as recited in EE 19 wherein the measured nuisance characteristic varies monotonically.

EE 21. The apparatus as recited in one or more of EE 18, EE 19 or EE 20, wherein the high specificity previous audio block or frame feature determination comprises one or more of a ratio or a prevalence of desired voice content in relation to the undesired temporal signal segment.

EE 22. The apparatus as recited in one or more of EE 18, EE 19, EE 20, or EE 21 further comprising a first computing unit configured to compute a moving statistic that relates to the desired voice content ratio or prevalence in relation to the undesired temporal signal segment.

EE 23. The apparatus as recited in EE 18, further comprising a second calculating unit configured to determine one or more features that identify a nuisance characteristic over the aggregate of two or more of the previously processed sequential audio blocks or frames;

wherein the nuisance measurement is further based on the nuisance feature identification.

EE 24. The apparatus as recited in EE 14, further comprising a first controller configured to:

control a gain application; and smooth the desired temporal audio signal segment commencement or termination based on the gain application control.

EE 25. The apparatus as recited in EE 24 wherein:

the smoothed desired temporal audio signal segment commencement comprises a fade-in; and the smoothed desired temporal audio signal segment termination comprises a fade-out.

EE 26. The apparatus as recited in one or more of EE 16 or EE 20 through EE 19, inclusive, further comprising a second controller configured to control a gain level based on the measured nuisance characteristic.

EE 27. A method of performing signal transmission control, comprising:

performing a voice activity detection on each present one of frames of an audio signal based on short-term features extracted from the present frame;

identifying the present frame as the start of a present voice segment if an onset-start event is detected from the present frame, wherein the present voice segment is initially assigned an adaptive length not smaller than a holdover length;

if the present frame is within the present voice segment, performing a voice/non-voice classification on the present frame based on long-term features extracted from the frames, to derive a measure of the number of frame classified as voice in the present frame;

calculating a voice ratio of the present frame as a moving average of the measures;

if an onset-continuation event is detected from the present frame and the voice ratio of an immediately previous frame relative to the present frame is greater than a first threshold, increasing the adaptive length;

if a non-onset event is detected from the present frame and the voice ratio of the immediately previous frame is less than the first threshold, reducing the adaptive length of the present voice segment, wherein the present frame is included in the reduced adaptive length; and for each of the frames, determining to transmit the frame or not to transmit the frame if the frame is or is not included in one of the voice segments.

EE 28. The method according to EE 27, wherein the audio signal is associated with a nuisance level indicating the possibility that a nuisance state exists at the present frame, and the method further comprises:

if a non-onset event is detected from the present frame, the present frame is the last frame of the present voice segment and the voice ratio of the immediately previous frame is less than the first threshold, increasing the nuisance level with a first rate;

if the present frame is within the present voice segment, if the voice ratio of present frame is greater than a second threshold and the portion of the present voice segment from the start to the present frame is longer than a third threshold, reducing the nuisance level with a second rate faster than the first rate; and if it is determined to transmit the present frame, calculating a gain applied to the present frame as a monotonically decreasing function of the nuisance level.

EE 29. The method according to EE 28, further comprising:

if a non-onset event is detected from the present frame, the present frame is the last frame of the present voice segment and the voice ratio of the immediately previous frame is greater than a fourth threshold higher than the first threshold, reducing the nuisance level with a third rate faster than the first rate.

EE 30. The method according to EE 28 or 29, further comprising:

if a non-onset event is detected from the present frame, the present frame is the last frame of the present voice segment and the length of the present voice segment is smaller than a nuisance threshold length, increasing the nuisance level with the first rate EE 31. The method according to EE 28 or 29, further comprising:

if a non-onset event is detected from the present frame and the nuisance level is greater than a fifth threshold, reducing the adaptive length of the present voice segment, wherein the present frame is included in the reduced adaptive length.

EE 32. The method according to EE 28 or 29, further comprising:

if a non-onset event is detected from the present frame and the present frame is not within the present voice segment, reducing the nuisance level with a fourth rate slower than the first rate.

EE 33. The method according to EE 28 or 29, further comprising:

if a non-onset event is detected from the present frame and the present frame is the last frame of the present voice segment, calculating the nuisance level as a quotient obtained by dividing the number of frames classified as voice in the present voice segment by the length of the present voice segment.

EE 34. The method according to EE 27 or 28 or 29, wherein the present frame is determined as within the present voice segment only if the portion of the present voice segment from the present frame to the end of the present voice segment is longer than a sixth threshold.

EE 35. The method according to EE 27 or 28 or 29, wherein the long-term features comprise the short-term features, or the short-term features and statistics on the short-term features.

EE 36. The method according to EE 28 or 29, further comprising:

detecting a predetermined class of signal which can cause a nuisance condition from the present frame based on long-term features extracted from the frames; and if the predetermined class of signal is detected, increasing the nuisance level.

37. An apparatus for performing signal transmission control, comprising:

a voice activity detector configured to perform a voice activity detection on each present one of frames of an audio signal based on short-term features extracted from the present frame;

a transmission controller configured to identify the present frame as the start of a present voice segment if an onset-start event is detected from the present frame, wherein the present voice segment is initially assigned an adaptive length not smaller than a holdover length; and a classifier configured to, if the present frame is within the present voice segment, perform a voice/non-voice classification on the present frame based on long-term features extracted from the frames, to derive a measure of the number of frame classified as voice in the present frame, wherein if the present frame is within the present voice segment, the transmission controller is further configured to calculate a voice ratio of the present frame as a moving average of the measures;

if an onset-continuation event is detected from the present frame and the voice ratio of an immediately previous frame relative to the present frame is greater than a first threshold, increase the adaptive length; and if a non-onset event is detected from the present frame and the voice ratio of the immediately previous frame is less than the first threshold, reduce the adaptive length of the present voice segment, wherein the present frame is included in the reduced adaptive length, and wherein for each of the frames, the transmission controller is further configured to determine to transmit the frame or not to transmit the frame if the frame is or is not included in one of the voice segments.

EE 38. The apparatus according to EE 37, wherein the audio signal is associated with a nuisance level indicating the possibility that a nuisance state exists at the present frame, and the transmission controller is further configured to:

if a non-onset event is detected from the present frame, the present frame is the last frame of the present voice segment and the voice ratio of the immediately previous frame is less than the first threshold, increase the nuisance level with a first rate;

if the present frame is within the present voice segment, if the voice ratio of present frame is greater than a second threshold and the portion of the present voice segment from the start to the present frame is longer than a third threshold, reduce the nuisance level with a second rate faster than the first rate; and if it is determined to transmit the present frame, calculate a gain applied to the present frame as a monotonically decreasing function of the nuisance level.

EE 39. The apparatus according to EE 38, wherein the transmission controller is further configured to:

if a non-onset event is detected from the present frame, the present frame is the last frame of the present voice segment and the voice ratio of the immediately previous frame is greater than a fourth threshold higher than the first threshold, reduce the nuisance level with a third rate faster than the first rate.

EE 40. The apparatus according to EE 38 or 39, wherein the transmission controller is further configured to:

if a non-onset event is detected from the present frame, the present frame is the last frame of the present voice segment and the length of the present voice segment is smaller than a nuisance threshold length, increase the nuisance level with the first rate EE 41. The apparatus according to EE 38 or 39, wherein the transmission controller is further configured to:

if a non-onset event is detected from the present frame and the nuisance level is greater than a fifth threshold, reduce the adaptive length of the present voice segment, wherein the present frame is included in the reduced adaptive length.

EE 42. The apparatus according to EE 38 or 39, wherein the transmission controller is further configured to:

if a non-onset event is detected from the present frame and the present frame is not within the present voice segment, reduce the nuisance level with a fourth rate slower than the first rate.

EE 43. The apparatus according to EE 38 or 39, wherein the transmission controller is further configured to:

if a non-onset event is detected from the present frame and the present frame is the last frame of the present voice segment, calculate the nuisance level as a quotient obtained by dividing the number of frames classified as voice in the present voice segment by the length of the present voice segment.

EE 44. The apparatus according to EE 37 or 38 or 39, wherein the present frame is determined as within the present voice segment only if the portion of the present voice segment from the present frame to the end of the present voice segment is longer than a sixth threshold.

EE 45. The apparatus according to EE 37 or 38 or 39, wherein the long-term features comprise the short-term features, or the short-term features and statistics on the short-term features.

EE 46. The apparatus according to EE 38 or 39, further comprising:

a nuisance classifying unit configured to detect a predetermined class of signal which can cause a nuisance condition from the present frame based on long-term features extracted from the frames, and the transmission controller is further configured to, if the predetermined class of signal is detected, increase the nuisance level.

EE 47. A computer-readable medium having computer program instructions recorded thereon, when being executed by a processor, the instructions enabling the processor to execute a method comprising:

receiving or accessing an audio signal that comprises a plurality of temporally sequential blocks or frames;

determining two or more features that characterize aggregately two or more of the sequential audio blocks or frames that have been processed previously within a time period that is recent in relation to a current point in time, wherein the feature determination exceeds a specificity criterion and is delayed in relation to the recently processed audio blocks or frames;

detecting an indication of voice activity in the audio signal, wherein the voice activity detection (VAD) is based on a decision that exceeds a preset sensitivity threshold and that is computed over a time period, which is brief in relation to the duration of each of the audio signal blocks or frames, and wherein the decision relates to one or more features of a current audio signal block or frame;

combining the high sensitivity short term VAD, the recent high specificity audio block or frame feature determination and information that relates to a state, which is based on a history of one or more previously computed feature determinations that are compiled from a plurality of features that are determined over a time that is prior to the recent high specificity audio block or frame feature determination time period; and outputting a decision relating to a commencement or termination of the audio signal, or a gain related thereto, based on the combination.

We claim:

1. A method, comprising:

receiving or accessing an audio signal that comprises a plurality of temporally sequential frames;

determining two or more features that characterize aggregately two or more of the sequential audio frames that have been processed previously within a time period that is recent in relation to a current point in time, wherein the feature determination exceeds a specificity criterion and is delayed in relation to the recently processed audio frames;

detecting an indication of voice activity in the audio signal, wherein the voice activity detection (VAD) is based on a decision that exceeds a preset sensitivity threshold and that is computed over a time period, which is brief in relation to the duration of each of the audio signal frames, and wherein the decision relates to one or more features of a current audio signal frame;

combining the high sensitivity short term VAD, the recent high specificity audio frame feature determination and information that relates to a state, which is based on a history of one or more previously computed feature determinations that are compiled from a plurality of features that are determined over a time that is prior to the recent high specificity audio frame feature determination time period;

outputting a decision relating to a commencement or termination of the audio signal, or a gain related thereto, based on the combination, wherein said state information includes a nuisance level associated with the audio signal, the nuisance level indicating a possibility that a nuisance state exists at the present frame, wherein the nuisance level is increased with a first rate if the present frame is the last frame of a present voice segment and a voice ratio of the immediately previous frame is less than a nuisance threshold, the voice ratio representing a prediction made at the time of the present frame, about a possibility that the next frame includes voice, and wherein the nuisance level is decreased with a second rate, the second rate faster than the first rate, if the present frame is within the present voice segment, the voice ratio of the present frame is greater than a voice ratio threshold value, and the portion of the present voice segment from its start to the present frame is longer than a time period threshold value; and selectively transmitting the present frame of the audio signal according to the decision.

2. The method as recited in claim 1 wherein the combining step further comprises combining one or more signals or determinations that relate to a feature that comprises a current or previously processed characteristic of the audio signal.

3. The method as recited in claim 1 wherein the state relates to one or more of a nuisance characteristic or a ratio of voice content in the audio signal to a total audio content thereof.

4. The method as recited in claim 1 wherein the combining step further comprises combining information that relates to a far end device or audio condition, which is communicatively coupled with a device that is performing the method.

5. The method as recited in claim 1, further comprising:

analyzing the determined features that characterize the recently processed audio frames;

based on the determined features analysis, inferring that the recently processed audio frames contain at least one undesired temporal signal segment; and measuring a nuisance characteristic based on the undesirable signal segment inference.

6. The method as recited in claim 5 wherein the measured nuisance characteristic varies.

7. The method as recited in claim 5 further comprising computing a moving statistic that relates to the desired voice content ratio or prevalence in relation to the undesired temporal signal segment.

8. The method as recited in claim 5, further comprising:

determining one or more features that identify a nuisance characteristic over the aggregate of two or more of the previously processed sequential audio frames;

wherein the nuisance measurement is further based on the nuisance feature identification.

9. The method as recited in claim 1, further comprising:

controlling a gain application; and smoothing the desired temporal audio signal segment commencement or termination based on the gain application control.

10. The method as recited in claim 9 wherein:

the smoothed desired temporal audio signal segment commencement comprises a fade-in; and the smoothed desired temporal audio signal segment termination comprises a fade-out.

11. The method as recited in claim 3, inclusive, further comprising controlling a gain level based on the measured nuisance characteristic.

12. An apparatus, comprising:

an inputting unit configured to receive or access an audio signal that comprises a plurality of temporally sequential frames;

a feature generator configured to determine two or more features that characterize aggregately two or more of the sequential audio frames that have been processed previously within a time period that is recent in relation to a current point in time, wherein the feature determination exceeds a specificity criterion and is delayed in relation to the recently processed audio frames;

a detector configured to detect an indication of voice activity in the audio signal, wherein the voice activity detection (VAD) is based on a decision that exceeds a preset sensitivity threshold and that is computed over a time period, which is brief in relation to the duration of each of the audio signal frames, and wherein the decision relates to one or more features of a current audio signal frame;

a combining unit configured to combine the high sensitivity short term VAD, the recent high specificity audio frame feature determination and information that relates to a state, which is based on a history of one or more previously computed feature determinations that are compiled from a plurality of features that are determined over a time that is prior to the recent high specificity audio frame feature determination time period;

a decision maker configured to output a decision relating to a commencement or termination of the audio signal, or a gain related thereto, based on the combination, wherein said state information includes a nuisance level associated with the audio signal, the nuisance level indicating a possibility that a nuisance state exists at the present frame, wherein the nuisance level is increased with a first rate if the present frame is the last frame of a present voice segment and a voice ratio of the immediately previous frame is less than a nuisance threshold, the voice ratio representing a prediction made at the time of the present frame, about a possibility that the next frame includes voice, and wherein the nuisance level is decreased with a second rate, the second rate faster than the first rate, if the present frame is within the present voice segment, the voice ratio of the present frame is greater than a voice ratio threshold value, and the portion of the present voice segment from its start to the present frame is longer than a time period threshold value; and a transmitter configured to selectively transmit the present frame of the audio signal according to the decision.

13. The apparatus as recited in claim 12 wherein the combining unit is further configured to combine one or more signals or determinations that relate to a feature that comprises a current or previously processed characteristic of the audio signal.

14. The apparatus as recited in claim 12 wherein the state relates to one or more of a nuisance characteristic or a ratio of voice content in the audio signal to a total audio content thereof.

15. The apparatus as recited in claim 12 wherein the combining unit is further configured to combine information that relates to a far end device or audio condition, which is communicatively coupled with a device that is performing the method.

16. The apparatus as recited in claim 12, further comprising a nuisance estimator configured to:

analyze the determined features that characterize the recently processed audio frames;

based on the determined features analysis, infer that the recently processed audio frames contain at least one undesired temporal signal segment; and measure a nuisance characteristic based on the undesirable signal segment inference.

17. The apparatus as recited in claim 16, further comprising a first computing unit configured to compute a moving statistic that relates to the desired voice content ratio or prevalence in relation to the undesired temporal signal segment.

18. The apparatus as recited in claim 16, further comprising a second calculating unit configured to determine one or more features that identify a nuisance characteristic over the aggregate of two or more of the previously processed sequential audio frames;

wherein the nuisance measurement is further based on the nuisance feature identification.

19. The apparatus as recited in claim 12, further comprising a first controller configured to:

control a gain application; and smooth the desired temporal audio signal segment commencement or termination based on the gain application control.

20. A method, comprising:

receiving or accessing an audio signal that comprises a plurality of temporally sequential blocks;

determining two or more features that characterize aggregately two or more of the sequential audio blocks that have been processed previously within a time period that is recent in relation to a current point in time, wherein the feature determination exceeds a specificity criterion and is delayed in relation to the recently processed audio blocks;

detecting an indication of voice activity in the audio signal, wherein the voice activity detection (VAD) is based on a decision that exceeds a preset sensitivity threshold and that is computed over a time period, which is brief in relation to the duration of each of the audio signal blocks, and wherein the decision relates to one or more features of a current audio signal block;

combining the high sensitivity short term VAD, the recent high specificity audio block feature determination and information that relates to a state, which is based on a history of one or more previously computed feature determinations that are compiled from a plurality of features that are determined over a time that is prior to the recent high specificity audio block feature determination time period;

outputting a decision relating to a commencement or termination of the audio signal, or a gain related thereto, based on the combination, wherein said state information includes a nuisance level associated with the audio signal, the nuisance level indicating a possibility that a nuisance state exists at the present block, wherein the nuisance level is increased with a first rate if the present block is the last block of a present voice segment and a voice ratio of the immediately previous block is less than a nuisance threshold, the voice ratio representing a prediction made at the time of the present block, about a possibility that the next block includes voice, and wherein the nuisance level is decreased with a second rate, the second rate faster than the first rate, if the present block is within the present voice segment, the voice ratio of the present block is greater than a voice ratio threshold value, and the portion of the present voice segment from its start to the present block is longer than a time period threshold value; and selectively transmitting the present block of the audio signal according to the decision.

* * * * *